US009874345B2

(12) United States Patent
Zimmermann

(10) Patent No.: US 9,874,345 B2
(45) Date of Patent: Jan. 23, 2018

(54) CANDELABRUM OF HANGING CANDLES

(71) Applicant: Micha Zimmermann, Haifa (IL)

(72) Inventor: Micha Zimmermann, Haifa (IL)

( * ) Notice: Subject to any disclaimer, the term of this patent is extended or adjusted under 35 U.S.C. 154(b) by 0 days.

(21) Appl. No.: 15/498,128

(22) Filed: Apr. 26, 2017

(65) Prior Publication Data

US 2017/0227212 A1 Aug. 10, 2017

Related U.S. Application Data

(63) Continuation of application No. 13/817,399, filed as application No. PCT/IB2011/053652 on Aug. 18, 2011, now Pat. No. 9,664,377.

(60) Provisional application No. 61/401,799, filed on Aug. 20, 2010.

(51) Int. Cl.

| | |
|---|---|
| ***F23D 3/16*** | (2006.01) |
| ***F21V 35/00*** | (2006.01) |
| ***F21S 13/12*** | (2006.01) |
| ***F21V 25/02*** | (2006.01) |

(52) U.S. Cl.

CPC ..... *F21V 35/003* (2013.01); *F21S 13/12* (2013.01); *F21V 25/02* (2013.01)

(58) Field of Classification Search

CPC ..... F21V 35/003; F21V 25/02; F21S 13/12
USPC ..... 431/295–297, 289; 362/391–393, 426, 362/209, 227, 249.01, 249.07–249.1, 405
See application file for complete search history.

(56) References Cited

U.S. PATENT DOCUMENTS

| | | | | |
|---|---|---|---|---|
| 1,940,841 | A | 12/1933 | Benziger | |
| 1,965,891 | A * | 7/1934 | French | C11C 5/025 118/400 |
| 2,007,773 | A * | 7/1935 | Schroeder | C11C 5/025 425/270 |
| 3,091,106 | A * | 5/1963 | Crouch | F21V 35/00 431/154 |
| 5,026,480 | A | 6/1991 | Fischer | |
| 5,944,505 | A * | 8/1999 | Kroecher | F23Q 25/00 431/149 |
| 6,106,125 | A * | 8/2000 | Finn | G03B 15/06 362/11 |
| 6,206,540 | B1 | 3/2001 | Vogel | |
| 2003/0116451 | A1 | 6/2003 | Dubsky | |
| 2007/0009846 | A1 | 1/2007 | Bolanos | |

OTHER PUBLICATIONS

Israel Museum, Jerusalem, Photos 1-15, dated Aug. 29, 2010.
Tel Aviv Museum, Tel Aviv, Photos 1-9, dated Mar. 3, 2011.
Museum of the Diaspora, Tel Aviv, Photos 1-20, dated Feb. 26, 2010.
MOMA, New York, Photos 1-4, dated Apr. 16, 2011.

(Continued)

*Primary Examiner* — Vivek Shirsat
(74) *Attorney, Agent, or Firm* — Nixon Peabody LLP

(57) ABSTRACT

A candelabrum includes a frame assembly, a pair of anchor beams, and at least one candle support. The frame assembly includes a first frame member, a second frame member, and at least one cross member. The first frame member is rigidly coupled to the second frame member via the at least one cross member. The pair of anchor beams is coupled to the frame assembly. The at least one candle support is pivotally coupled to the pair of anchor beams. The at least one candle support is configured to receive a candle therein.

25 Claims, 38 Drawing Sheets

(56) References Cited

OTHER PUBLICATIONS

Jewish Museum, New York, Photos 1-2, dated Apr. 16, 2011.
Jewish Museum, London, Photo 1-1, dated Apr. 16, 2011.
Jewish Museum, Philadelphia, Photos 1-5, dated Apr. 16, 2011.
Jewish Museum of Art & History, Paris, Photo 1-1, undated, prior to Apr. 16, 2011.
Jewish Museum, Amsterdam, Photos 1-2, dated Mar. 3, 2011.
International Search Report for International Application No. PCT/IB11/53652, dated Jan. 23, 2012, 2 pages.
Written Opinion for International Application No. PCT/IB11/53652, dated Jan. 23, 2012, 6 pages.

* cited by examiner

CANDELABRUM OF HANGING CANDLES

CROSS-REFERENCE TO RELATED APPLICATIONS

This application is a continuation of U.S. patent application Ser. No. 13/817,399, filed Feb. 15, 2013, now allowed, which is a National Stage of International Application No. PCT/IB2011/053652, filed Aug. 18, 2011, which claims the benefit of U.S. Provisional Application No. 61/401,799, filed Aug. 20, 2010, each of which is hereby incorporated by reference herein in its entirety.

FIELD OF THE INVENTION

The present description relates generally to candelabrums and methods of using the same, and more particularly, to candelabrums for holding one or more candles in, for example, a Hanukia, a Menorah, or for any other purpose.

BACKGROUND OF THE INVENTION

People use many different types of candelabrums for various purposes.

SUMMARY OF THE INVENTION

The present disclosure is directed to a customizable candelabrum that can be used for various purposes, such as, for example, as a Hanukia or Menorah, as Shabbat Candlesticks, etc. The candelabrum generally includes a frame assembly, a pair of anchor beams, and a plurality of candle supports. The frame assembly is rollable such that the frame assembly can be rolled horizontally along a surface (e.g., a table) and/or rocked back-and-forth in position on the surface. Each of the pair of anchor beams includes a plurality of slots or apertures configured to receive a portion of each of the plurality of candle supports. Each of the candle supports is pivotally attached to one or both of the beams such that the candle supports pivotally hang thereon. As the frame assembly is rolled and/or rocked in one direction or the other, the candle holders pivot with respect to the beams and the frame assembly to remain substantially vertical due to gravitational forces acting thereon. The center of mass of each of the candle holders is positioned below the pivot point of the respective candle holder such that candles placed therein remain in an upright and safe operating position.

BRIEF DESCRIPTION OF THE DRAWINGS

The foregoing and other advantages of the present disclosure will become apparent upon reading the following detailed description and upon reference to the drawings.

DETAILED DESCRIPTION OF THE ILLUSTRATED EMBODIMENTS

Figure 1A:
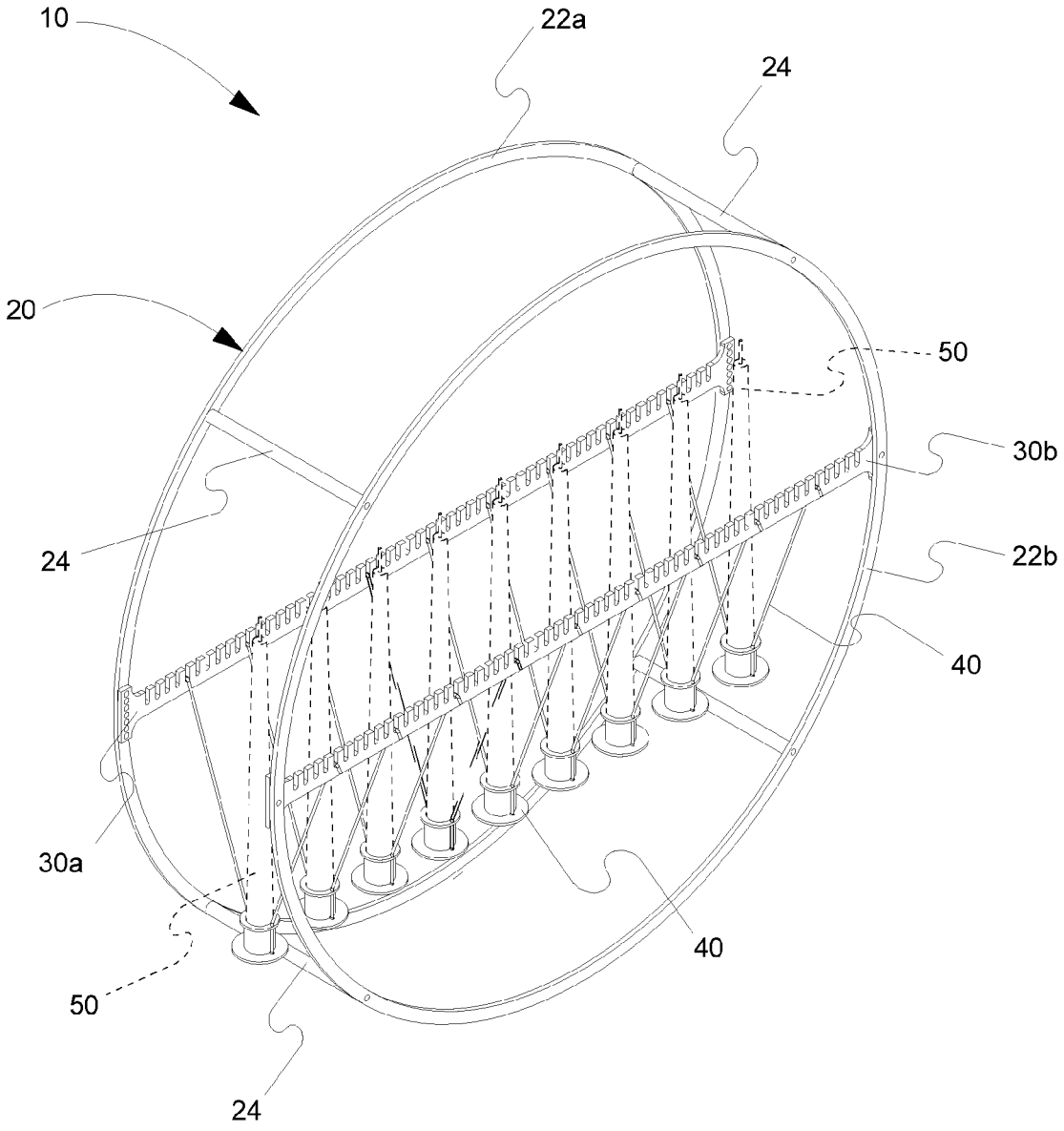
FIG. 1A is a perspective view of a candelabrum with candles installed according to some aspects of the present disclosure.
Figure 1B:
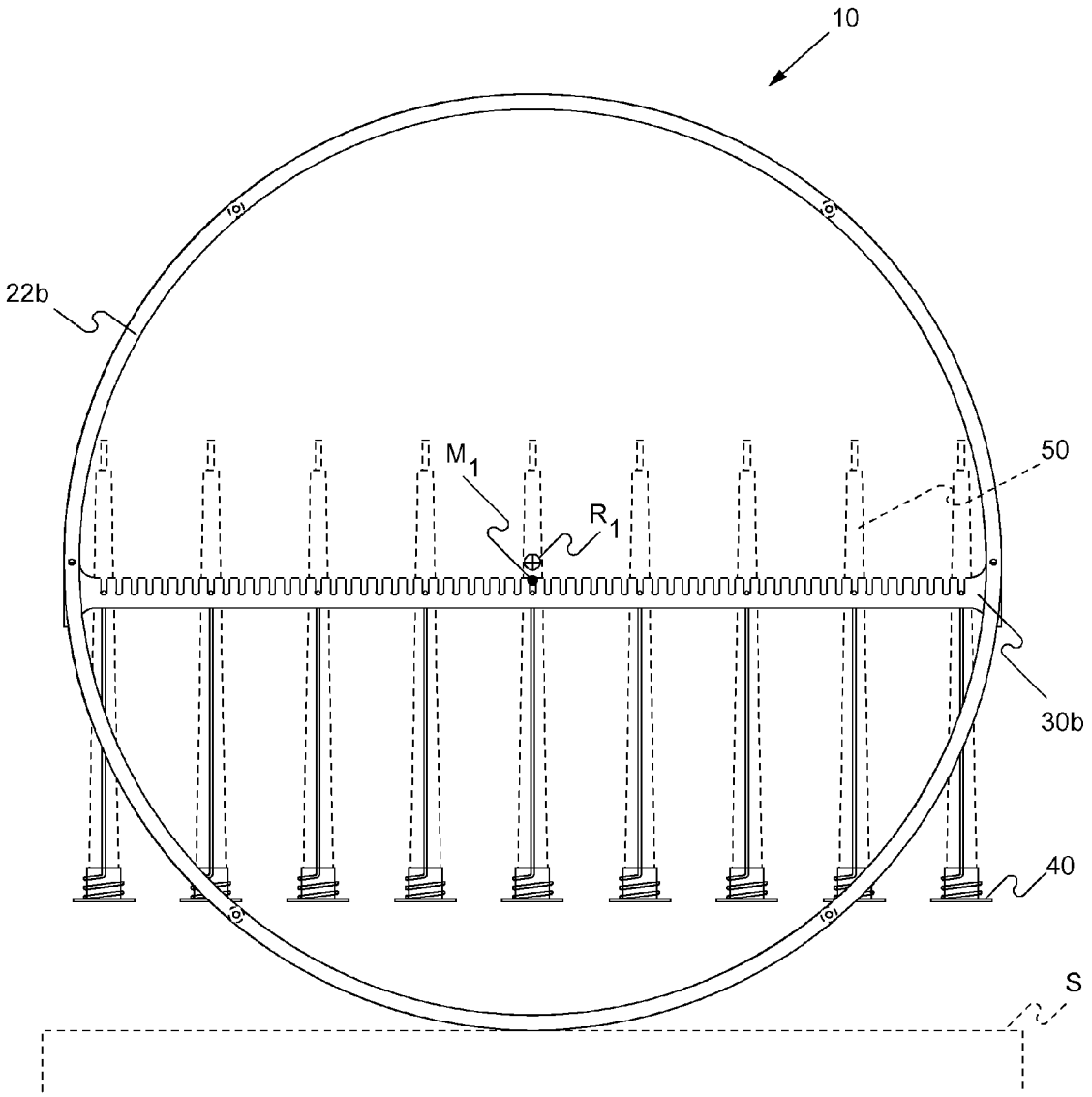
FIG. 1B is a front view of the candelabrum of FIG. 1A.
Figure 1D:
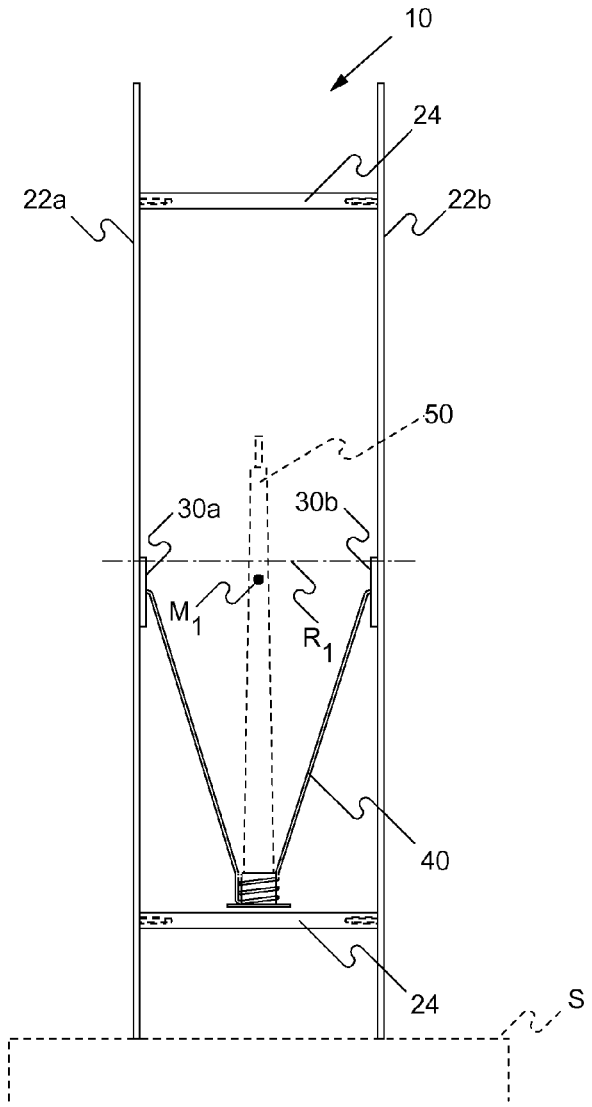
FIG. 1D is a side view of the candelabrum of FIG. 1A.
Figure 1C:
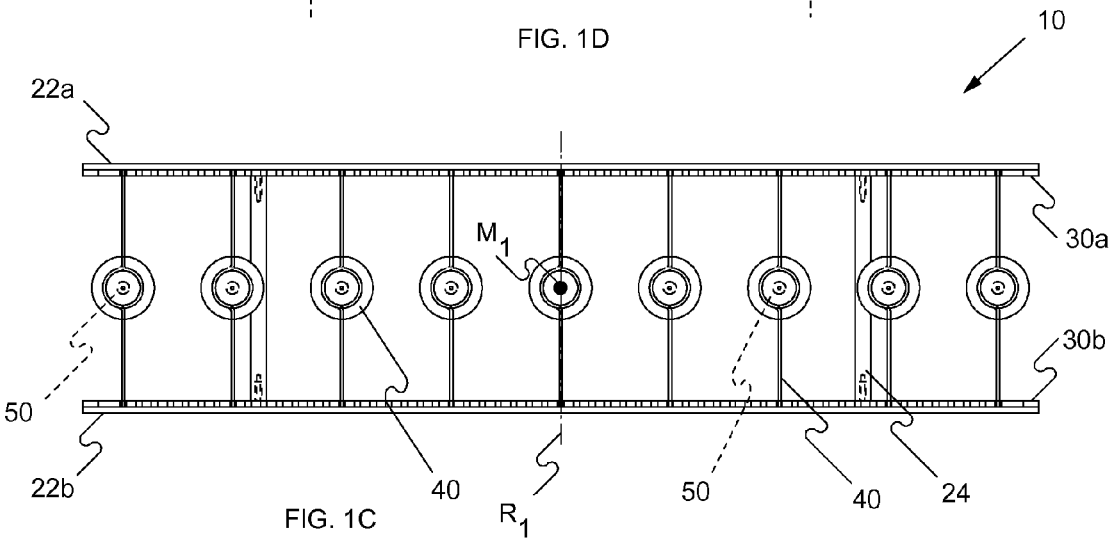
FIG. 1C is a top view of the candelabrum of FIG. 1A.

Although the present disclosure will be described in connection with certain aspects and/or embodiments, it will be understood that the present disclosure is not limited to those particular aspects and/or embodiments. On the contrary, the present disclosure is intended to cover all alternatives, modifications, and equivalent arrangements as may be included within the spirit and scope of the present disclosure as defined by the appended claims.

Referring to FIGS. 1A-1D, a candelabrum 10 includes a frame assembly 20, a pair of anchor beams 30*a,b*, and a plurality of candle supports 40. Each of the candle supports 40 can hold a candle 50 therein, as shown. The candelabrum 10 is shown as including a plurality of candle supports 40; however, the candelabrum 10 can include one or more candle supports 40. For example, the candelabrum 10 may only include one candle support 40. For another example, the candelabrum can include three, four, eight, nine, ten, twenty, etc. candle supports 40.

The candelabrum 10 includes a center of mass $M_1$ (best shown in FIGS. 1B and 1D) that is below an axis of rotation $R_1$ of the candelabrum 10. Such an arrangement of the center of mass $M_1$ and the axis of rotation $R_1$ means that the candelabrum 10 is in a state of stable equilibrium when the center of mass $M_1$ is directly below the axis of rotation $R_1$ as shown, for example, in FIG. 1B.

Figure 2B:
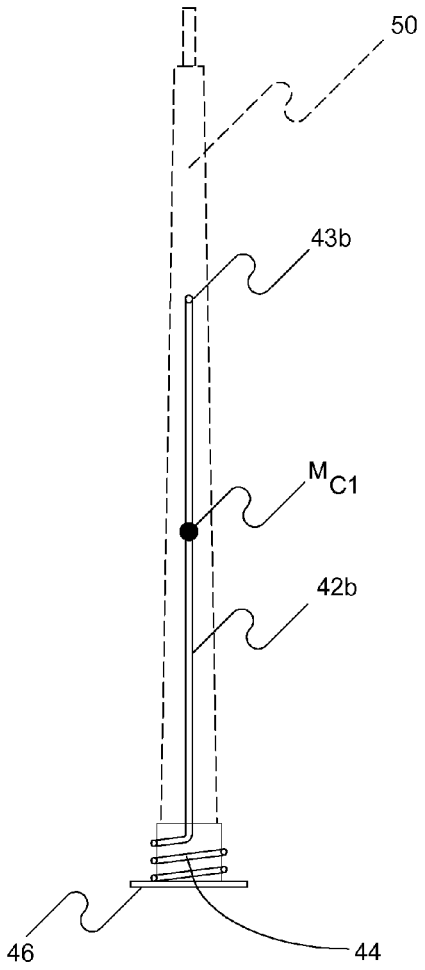
FIG. 2B is a front view of the candle holder of FIG. 2A.
Figure 2A:
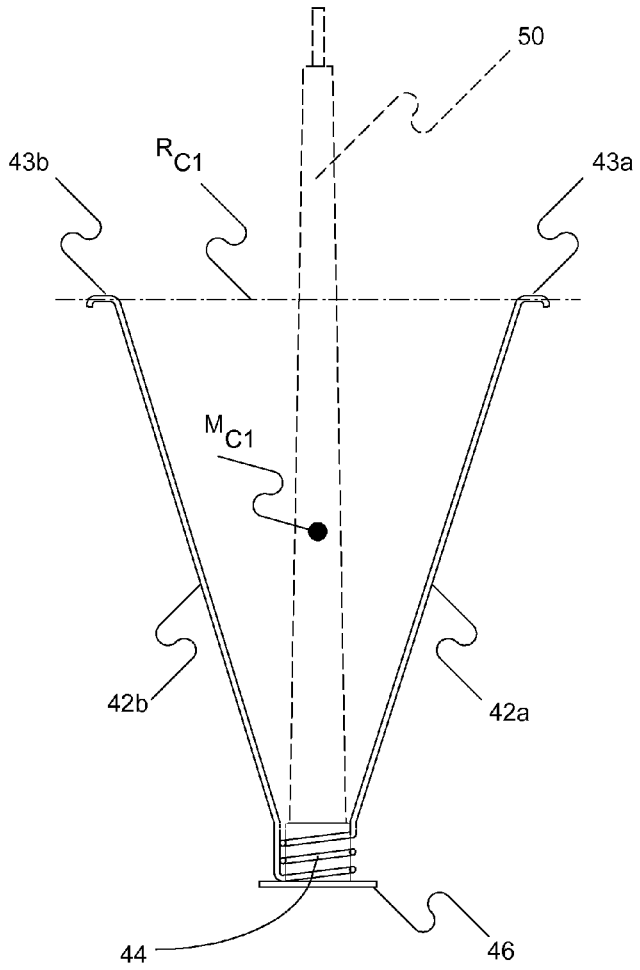
FIG. 2A is a side view of a candle holder of the candelabrum of FIG. 1A according to some aspects of the present disclosure.

Referring to FIGS. 2A and 2B, each of the candle supports 40 includes a pair of arms 42*a,b*, a pair of pivot portions 43*a,b*, an attachment portion 44, and a base 46. The candle 50 is mounted in and/or supported by the base 46 of the candle support 40. The base 46 is attached to the pair of arms 42*a,b* via the attachment portion 44. The attachment portion 44 can be an extension of the pair of arms 42*a,b* bent and/or curled around a portion of the base 46 as shown in FIGS. 2A and 2B. The attachment portion 44, the pair of arms 42*a,b*, and the pair of pivot portions 43*a,b* can be made of one part, such as, for example, one piece of wire bent and/or curled into the shape shown. The attachment portion 44 can be attached to the base 46 via a solder connection, a glue connection, a weld connection, etc. Alternatively, the candle support 40 can be formed without the base 46. In such an alternative, the attachment portion 44 can be formed to hold and support a candle therein.

A center of mass $M_{C1}$ of the combination of the candle 50 and the candle support 40 is designed to be lower than an axis of rotation $R_{C1}$ or the pivot point of the candle support 40, which is at the location where the pivot portions 43*a,b* engage the pair of anchor beams 30*a,b* (see e.g., FIG. 1A). Such a location of the center of mass $M_{C1}$ aids in maintaining stability of each candle 50 when installed in the candelabrum 10. Each candle 50 and candle support 40 combination can swing and/or pivot back and forth about the respective stable equilibrium position of the combination due to an outside disturbance applied to the candelabrum 10. This swinging movement subsides after a while when the externally applied disturbance is removed and the candelabrum 10 is allowed to return to its resting or equilibrium position in which the center of mass $M_{C1}$ is substantially vertically below the axis of rotation $R_{C1}$ (shown in FIG. 1A).

The base 46 of the candle support 40 is coupled to the pair of arms 42*a,b* and is located below the pivot portions 43*a,b* that define the axis of rotation $R_{C1}$ of the candle support 40. The center of mass of the arms 42*a,b*, the attachment portion 44, and the pivot portion 43*a,b* is also located below the pivot portion 43*a,b*. The center of mass of the candle support 40 is therefore located below the axis of rotation $R_{C1}$ of the candle support 40. A candle 50 whose center of mass is lower than the pivot portion 43*a,b* can be placed into the base 46. The combination of the candle support 40 and the candle 50 has a center of mass $M_{C1}$ that is located lower than the axis of rotation $R_{C1}$, even as the candle burns away. The mass of the candle support 40 is usually negligible compared to an un-burnt candle 50. Thus, the position of the center of mass of the candle 50 dominates the location of the center of mass $M_{C1}$ of the combination of the candle 50 and the candle support 40. A low center of mass $M_{C1}$, relative to the axis of rotation $R_{C1}$, increases the restoring force which returns the candle support 40 and candle 50 to the substantially vertical equilibrium position. That is, the lower the center of mass $M_{C1}$, the faster the candle support 40 and candle 50 return to the substantially vertical equilibrium position after an external disturbance is removed from the candelabrum 10.

The candelabrum 10 is designed such that the candle(s) 50 is/are biased to keep an upright (i.e., vertical) position when the candelabrum 10 is in the equilibrium position (FIG. 1A); however, it is contemplated that the candle support 40 and/or one or more other portions of the candelabrum 10 can be modified such that the candle(s) 50 is/are biased in a non-upright (i.e., non-vertical or angled) position with respect to vertical when the candelabrum 10 is in the equilibrium position (not shown).

Figure 3A:
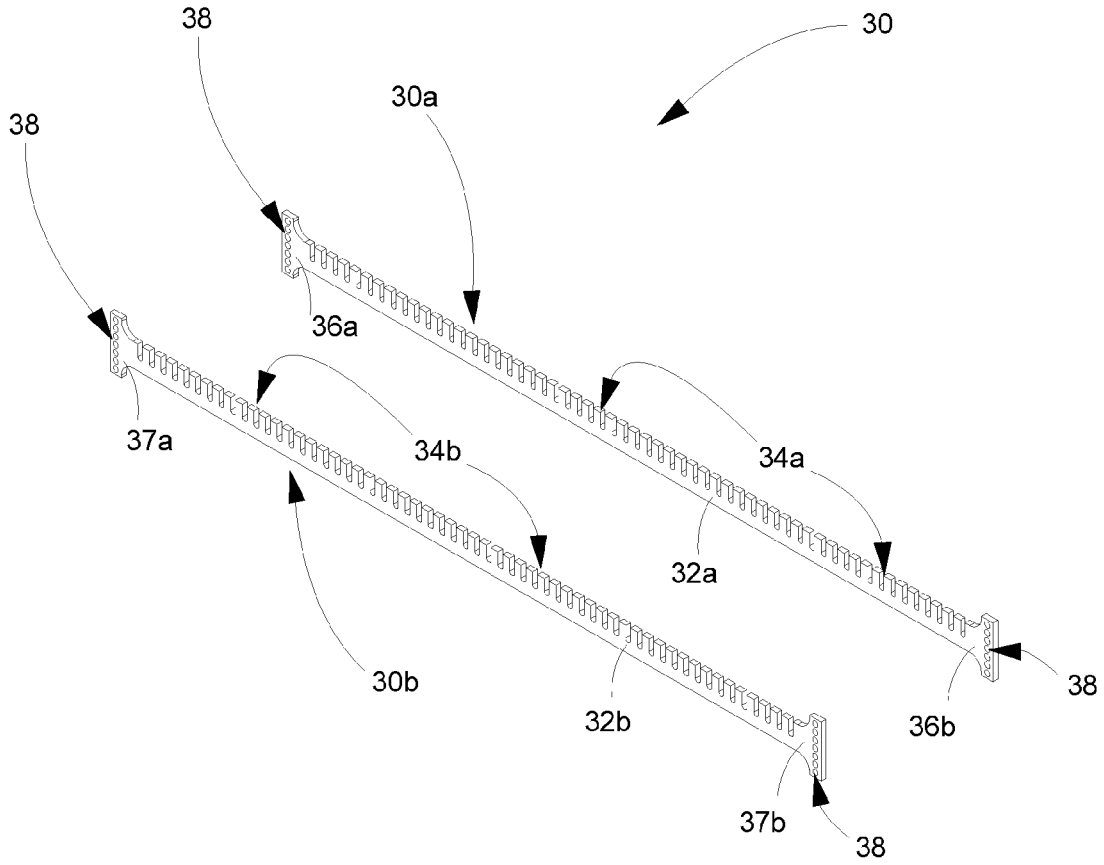
FIG. 3A is a perspective view of a pair of anchor beams of the candelabrum of FIG. 1A according to some aspects of the present disclosure.
Figure 3B:
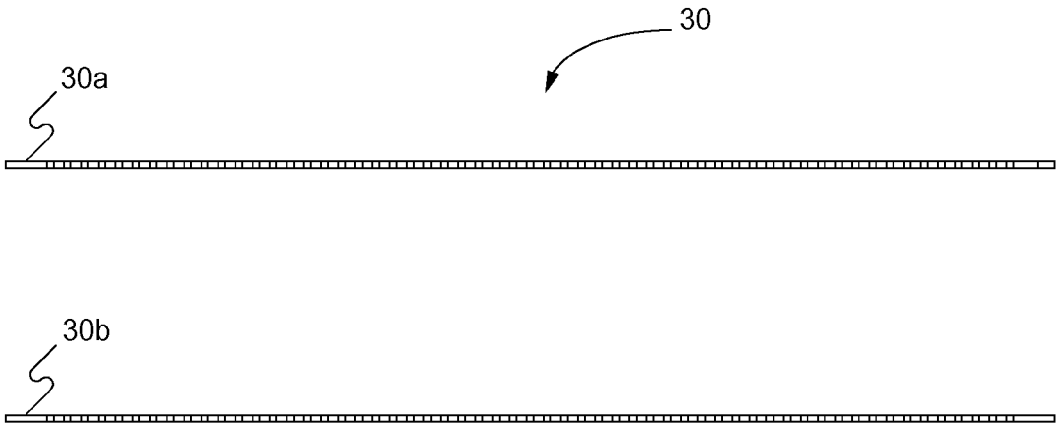
FIG. 3B is a top view of the pair of anchor beams of FIG. 3A.

Referring to FIGS. 3A and 3B, the pair of anchor beams 30*a,b* includes a first anchor beam 30*a* and a second anchor beam 30*b* generally parallel to the first anchor beam 30*a*. Each of the candle supports 40 is pivotally coupled to the pair of anchor beams 30*a,b* as shown in FIG. 1. Specifically, each of the candle supports 40 is pivotally suspended from both of the anchor beams 30*a,b*. Alternatively, the anchor beams 30*a,b* can be non-parallel.

The first anchor beam 30*a* includes a body 32*a*, a plurality of slots or apertures 34*a*, first and second ends 36*a,b*, and adjustment apertures 38. Similarly, the second anchor beam 30*b* includes a body 32*b*, a plurality of slots or apertures 34*b*, first and second ends 37*a,b*, and adjustment apertures 38. Each of the anchor beams 30*a,b* has a length that is substantially the same as the diameter of frame members 22*a,b* (shown and described below in reference to FIGS. 4A-4C) of the frame assembly 20. The adjustment apertures 38 are positioned in the ends 36*a,b* and 37*a,b* of the first and the second anchor beams 30*a,b*, respectively. The adjustment apertures 38 allow for the pair of anchor beams 30*a,b* to be adjusted vertically with respect to the frame assembly 20.

Adjustment of the vertical attachment position of the pair of anchor beams 30*a,b* shifts the center of mass $M_1$ of the candelabrum 10, which results in varying responses when external disturbances are provided. For example, the lower the pair of anchor beams 30*a,b* is attached to the frame assembly 20, the lower the center of mass $M_1$ of the candelabrum 10, which provides a relatively shorter response time (i.e., the candelabrum 10 returns to its equilibrium position (FIG. 1A) faster as compared to when the pair of anchor beams 30*a,b* is attached to the frame assembly 20 at a relatively higher position).

Figure 14A:
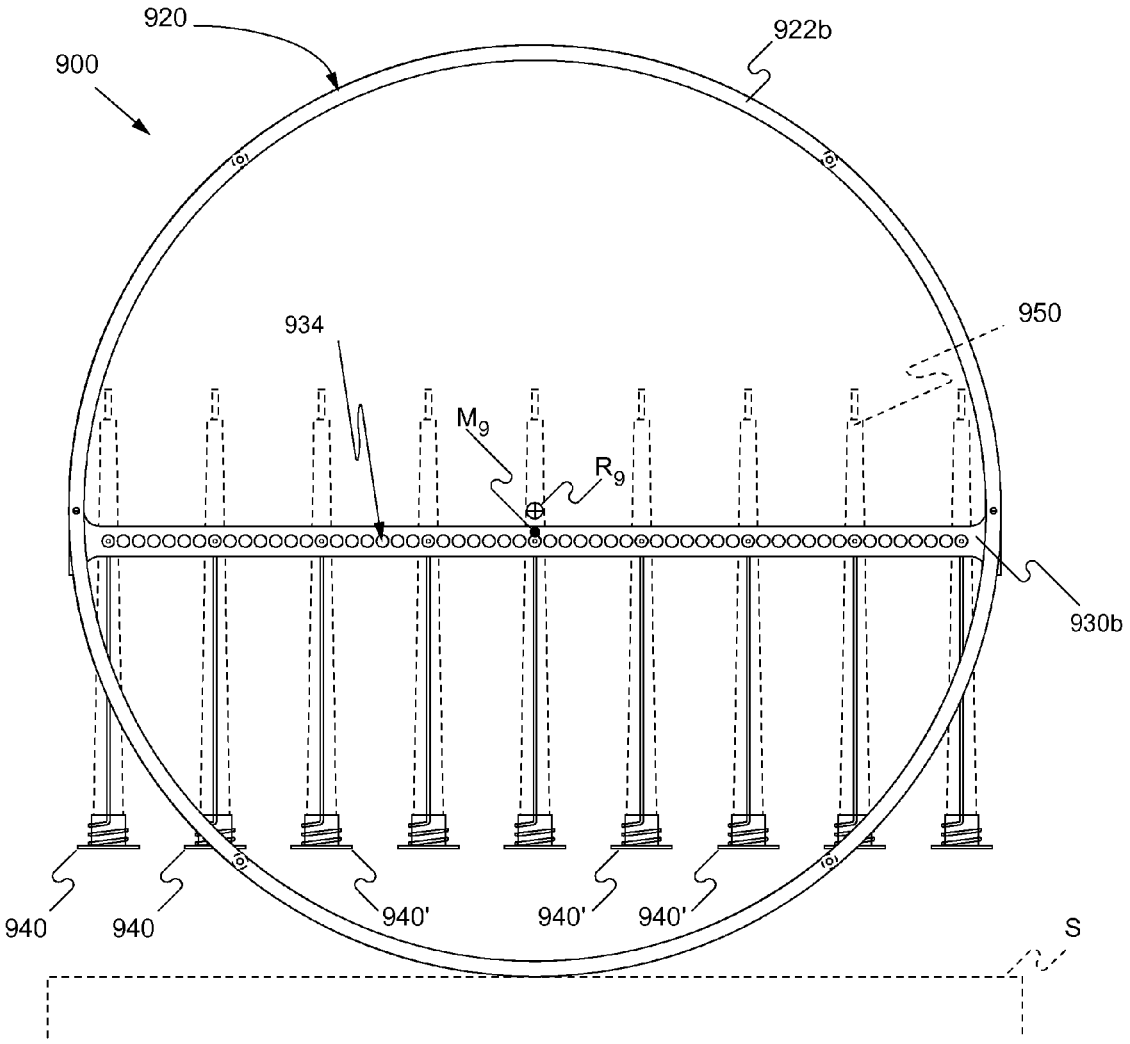
FIG. 14A is a front view of a candelabrum according to some aspects of the present disclosure.
Figure 14B:
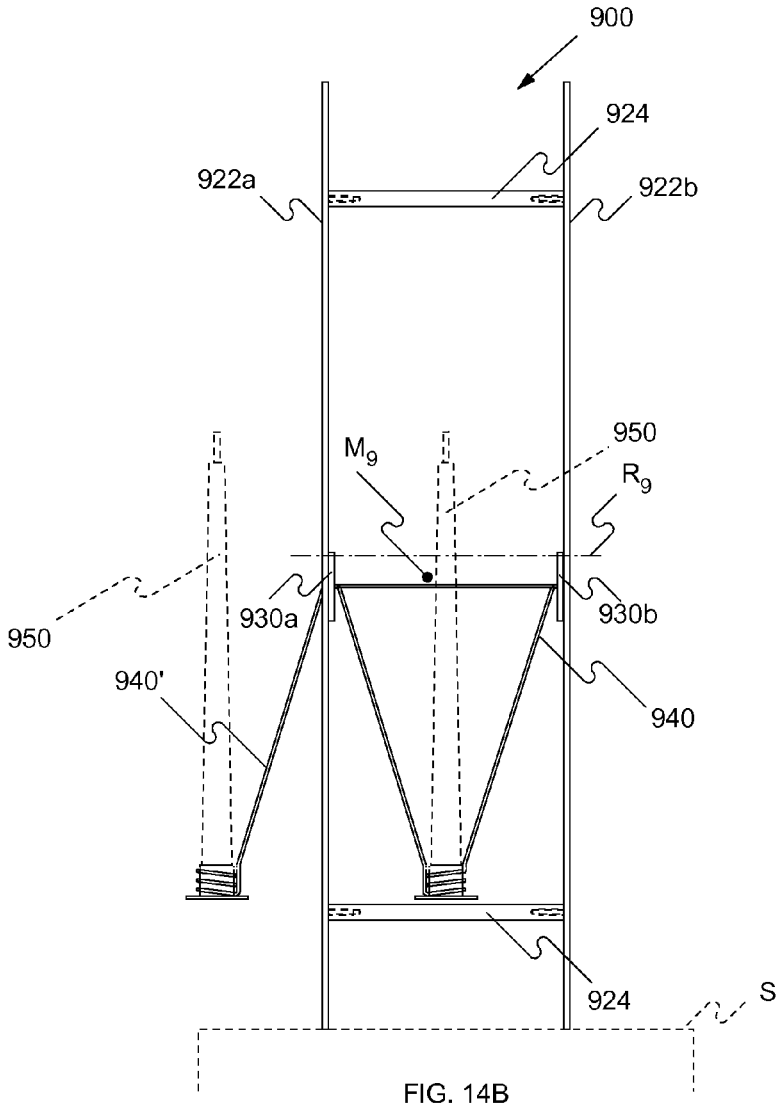
FIG. 14B is a side view of the candelabrum of FIG. 14A.
Figure 14C:
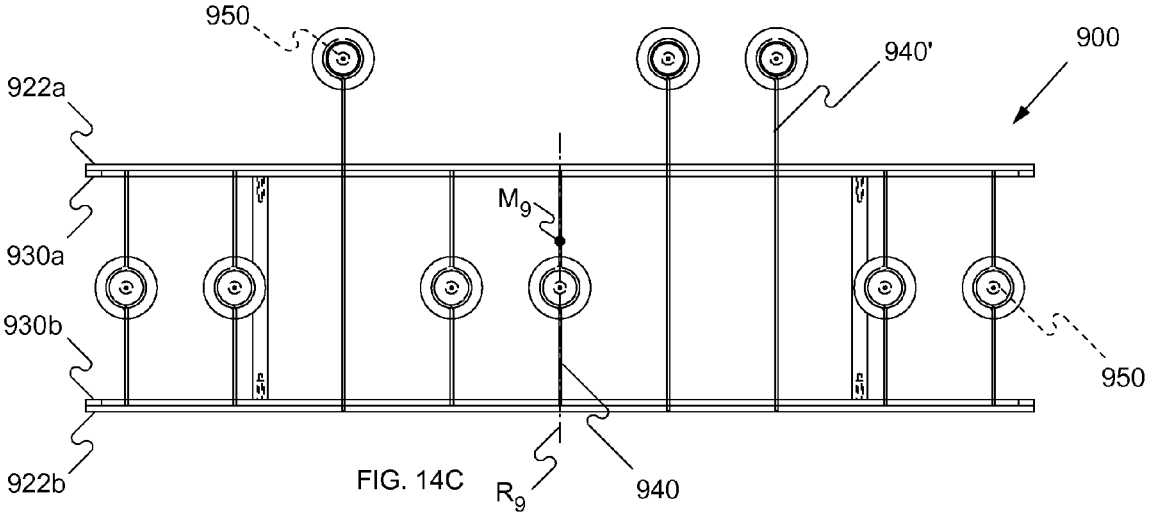
FIG. 14C is a top view of the candelabrum of FIG. 14A.

The pair of pivot portions 43*a,b* (FIG. 2A) of the candle supports 40 are configured to pivotally engage corresponding ones of the slots 34*a,b* (FIG. 3A) of the first and the second anchor beams 30*a,b*, respectively. For a particular candle support 40, the pivot portions 43*a,b* can be placed inside of the corresponding slots 34*a,b* such that the candle support 40 is free to rock back-and-forth therein. Alternatively to the beams 30*a,b* including slots 34*a,b*, the beams 30*a,b* can include apertures (see e.g., FIGS. 14A and 18A). In order to install a candle support 40 in such a candelabrum with apertures in lieu of slots, the arms 42*a,b* of the candle support 40 can be pinched and/or squeezed together to provide sufficient clearance for the pivot portions 43*a,b* to be positioned through corresponding ones of the apertures in the pair of anchor beams 30*a,b*. That is, the arms 42*a,b* are resilient to allow installation.

The pair of anchor beams 30*a,b* is mounted to the frame assembly 20 as shown in FIG. 1A. The pair of anchor beams 30*a,b* can be attached to the frame assembly 20 via a variety of connections, such as, for example, a screw connection, a nut and bolt connection, a glue connection, a weld connection, etc., or a combination thereof.

Figure 4A:
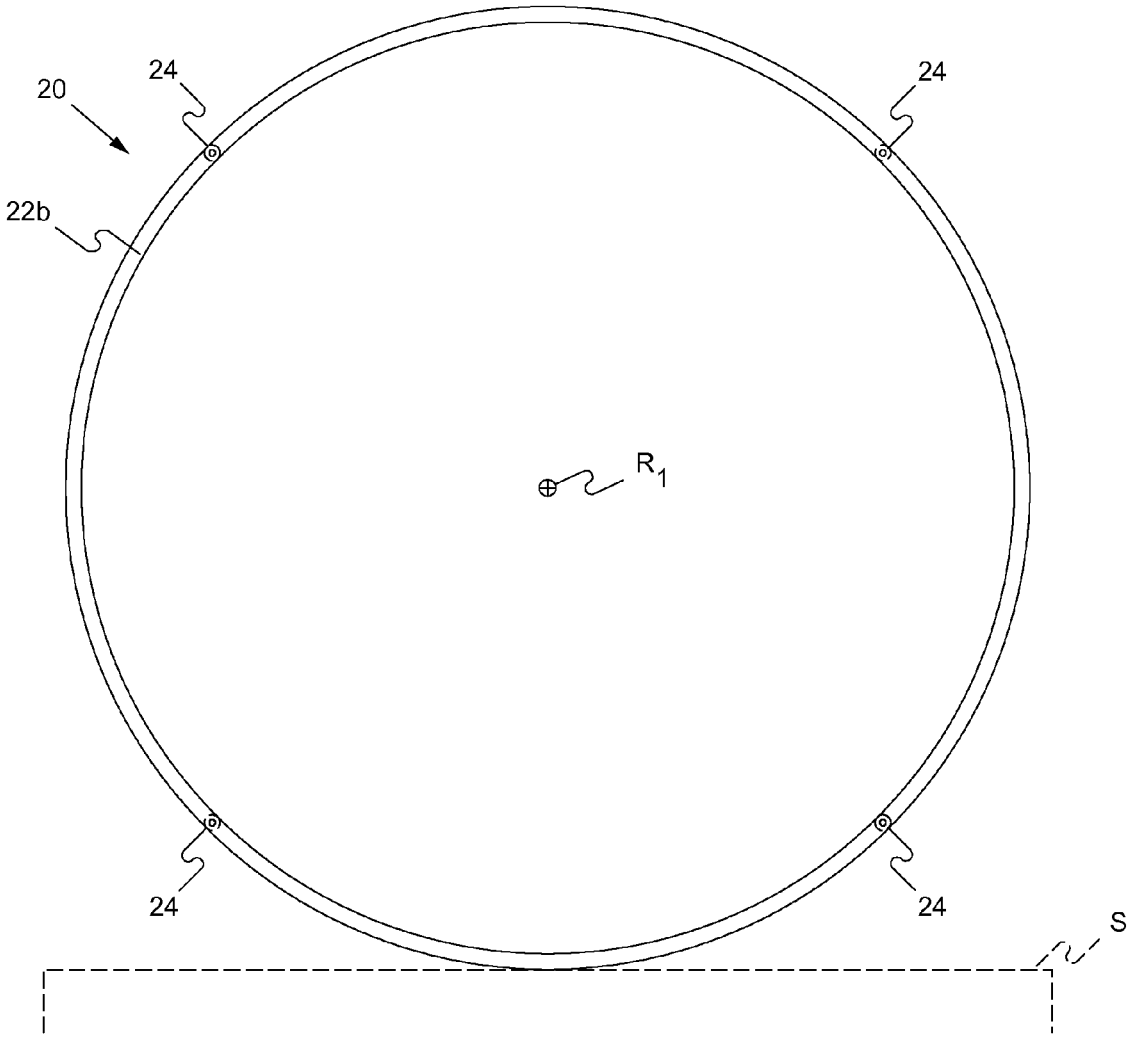
FIG. 4A is a front view of a frame assembly of the candelabrum of FIG. 1A according to some aspects of the present disclosure.
Figure 4C:
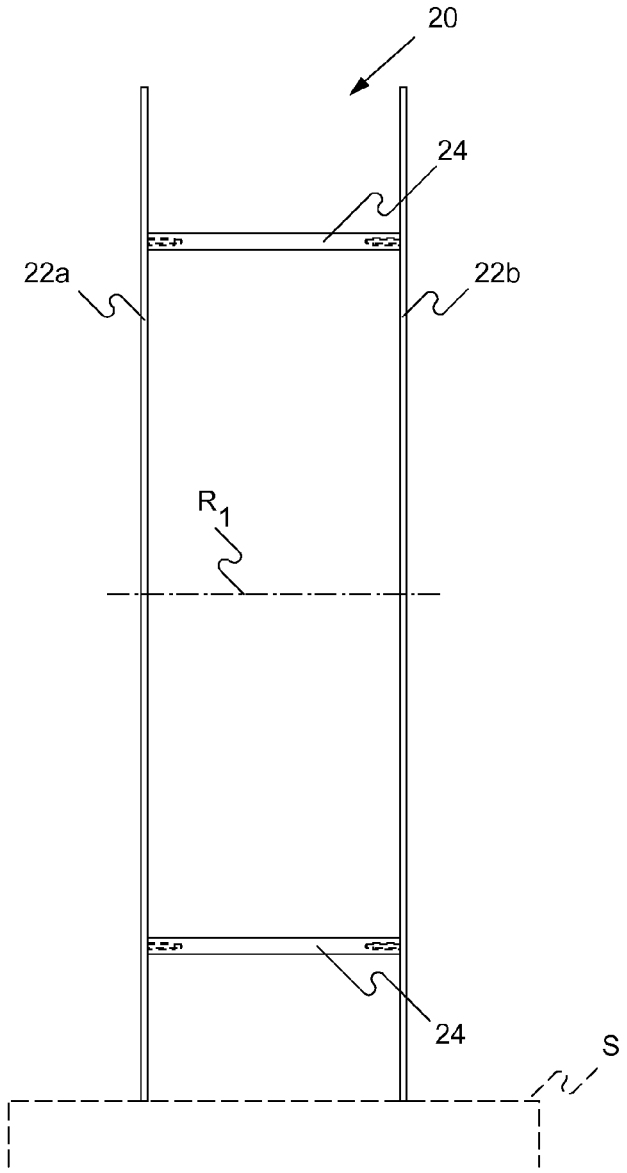
FIG. 4C is a side view of the frame of FIG. 4A.
Figure 4B:
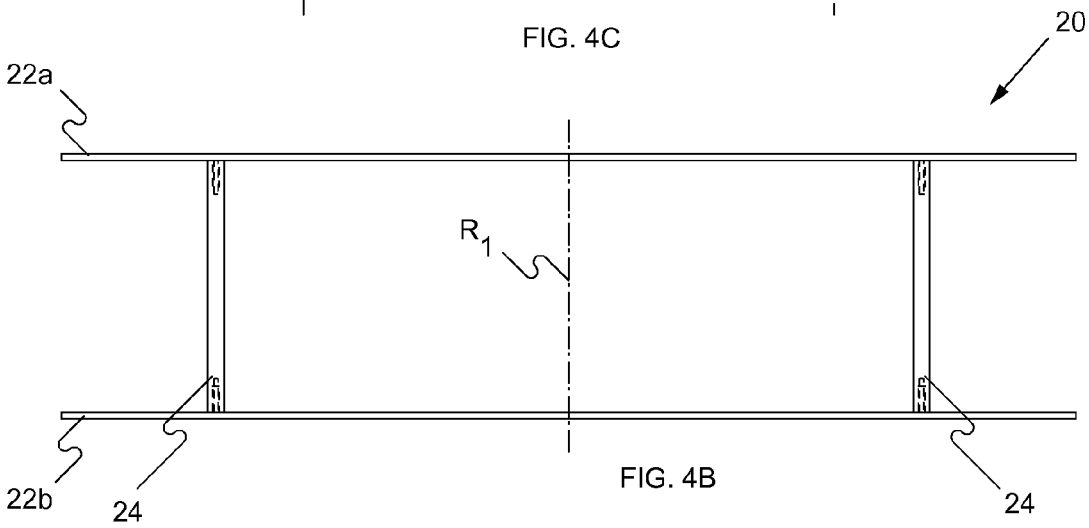
FIG. 4B is a top view of the frame of FIG. 4A.

Referring to FIGS. 4A-4C, the frame assembly 20 includes first and second frame members 22*a,b*, and four cross members 24. The first and the second frame members 22*a,b* are spaced apart and coupled together via the cross members 24. While four cross members are shown, any number of cross members can be used, such as, for example, one, two, four, five, ten, twenty, etc. Each additional cross member 24 adds structural rigidity to the frame assembly 20. The cross members 24 can be attached to the frame members 22*a,b* via many types of connections, such as, for example, weld connections, glue connections, screw connections, press-fit connections, etc., or a combination thereof.

As the frame members 22*a,b* are substantially circular, the frame assembly 20 itself is substantially circular, as shown from the front view (FIG. 4A). Such a frame assembly permits the frame assembly 20 to be rolled on a surface, S. For example, the frame assembly 20 is configured to roll on a table when excited from an exterior force such as a person pushing on one of the cross members 24 and/or any portion(s) of the candelabrum 10.

The frame assembly 20 and the pair of anchor beams 30*a,b* are shown as being separate parts; however, the frame assembly 20 and the pair of anchor beams 30*a,b* can be monolithic such that the height or vertical positioning of the pair of anchor beams 30*a,b* is fixed (i.e., not adjustable) within the frame assembly 20.

The position of the pair of anchor beams 30*a,b* within the frame assembly 20 and the distribution of the candle supports 40 coupled to the pair of anchor beams 30*a,b* is adjustable such that the center of mass $M_1$ of the candelabrum 10 can be adjusted vertically and/or horizontally. Positioning of the center of mass $M_1$ below the axis of rotation $R_1$ of the frame assembly 20 is desirable to maintain stability of the candelabrum 10, which is especially important when lit candles are placed in the candelabrum 10. The candelabrum 10 is in the stable equilibrium position (e.g., FIG. 1A) when the center of mass $M_1$ of the candelabrum 10 is directly below the axis of rotation $R_1$ of the frame assembly 20. The axis of rotation $R_1$ of the frame assembly 20 is determined by the radius of curvature of the frame members 22*a,b* at the contact point of the frame members 22*a,b* with the surface, S, on which the candelabrum 10 is resting (e.g., on a table). For a horizontal resting surface, S, the candelabrum 10 can swing or rock back-and-forth about its stable equilibrium position due to an externally applied disturbance. This swinging movement subsides after the externally applied disturbance is removed.

The frame members 22*a,b* are shown in FIGS. 4B and 4C as being parallel. This is due in part to the cross members 24 having the same length. Alternatively, the cross members 24 can be of varying lengths (e.g., two or more different lengths) such that the frame members 22*a,b* are not parallel or skewed with respect to one another (not shown).

Figure 5:
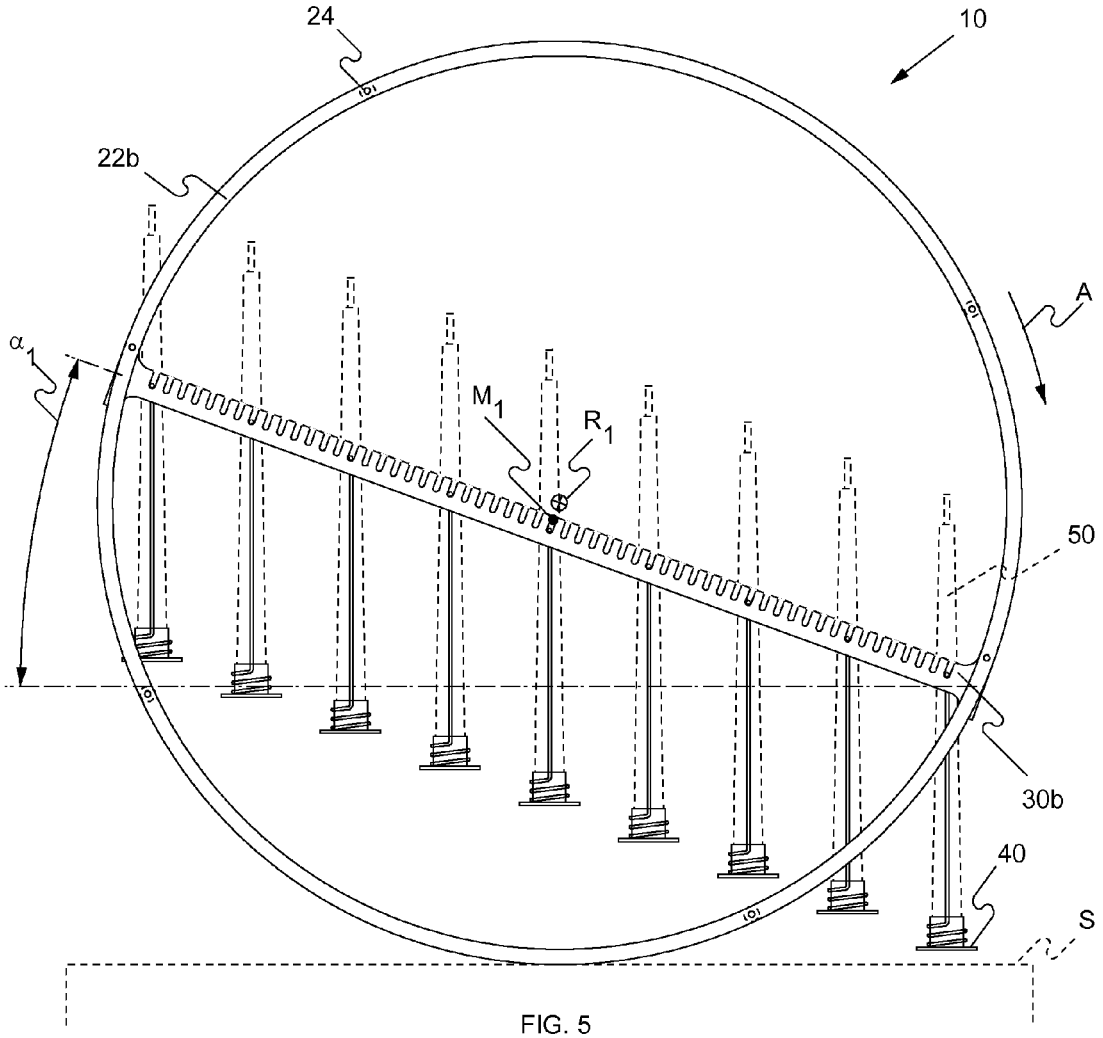
FIG. 5 is a front view of the candelabrum of FIG. 1A in an instantaneous rolled position according to some aspects of the present disclosure.

Referring to FIG. 5, the candelabrum 10 is shown in an instantaneous rolled position. Comparing the instantaneous rolled position (FIG. 5) of the candelabrum 10 with the stable equilibrium position (FIG. 1A), it is seen that the frame assembly 20 has been rotated clockwise in the direction of arrow A such that the pair of anchor beams 30*a,b* are at an angle $\alpha_1$ with respect to horizontal. The angling of the beams 30*a,b* causes the candle supports 40 and the candles 50 therein to swing and/or pivot within the plurality of respective slots 34*a,b* such that the heights of the respective bases 46 of the candle supports 40 vary depending on the location of the respective candle support 40 along the length of the pair of anchor beams 30*a,b*. Each of the candle supports 40 and candles 50 therein maintain a substantially upright vertical position due to the respective centers of mass $M_{C1}$ (FIG. 2A) of the candle supports 40 and the candles 50 therein, and also due to the centers of mass $M_{C1}$ residing below the respective axis of rotation $R_{C1}$ (FIG. 2A). That is, gravitational forces acting on the candelabrum 10 cause the respective candle supports 40 and the candles 50 therein to maintain substantially vertical orientations.

The candle supports 40 can be positioned at any point along the length of the pair of anchor beams 30*a,b*. For example, if more weight (i.e., more candle supports 40 and candles 50) is positioned on the right side of the pair of anchor beams 30*a,b*, then the center of mass $M_1$ shifts to the right and the stable equilibrium position of the candelabrum 10 shifts accordingly and the frame assembly 20 rotates in the direction of arrow A (FIG. 5). That is, the stable equilibrium position of the candelabrum 10 changes such that the center of mass $M_1$ is below the axis of rotation $R_1$ and the pair of anchor beams 30*a,b* is positioned at an angle (e.g., $\alpha_1$) relative to horizontal due to the uneven distribution of weight along the pair of anchor beams 30*a,b*. On the contrary, if more weight (i.e., more candle supports 40 and candles 50) is positioned on the left side of the pair of anchor beams 30*a,b*, then the stable equilibrium position of the candelabrum 10 shifts accordingly and the frame assembly 20 rotates in the direction opposite of the direction of arrow A (FIG. 5).

Figure 6A:
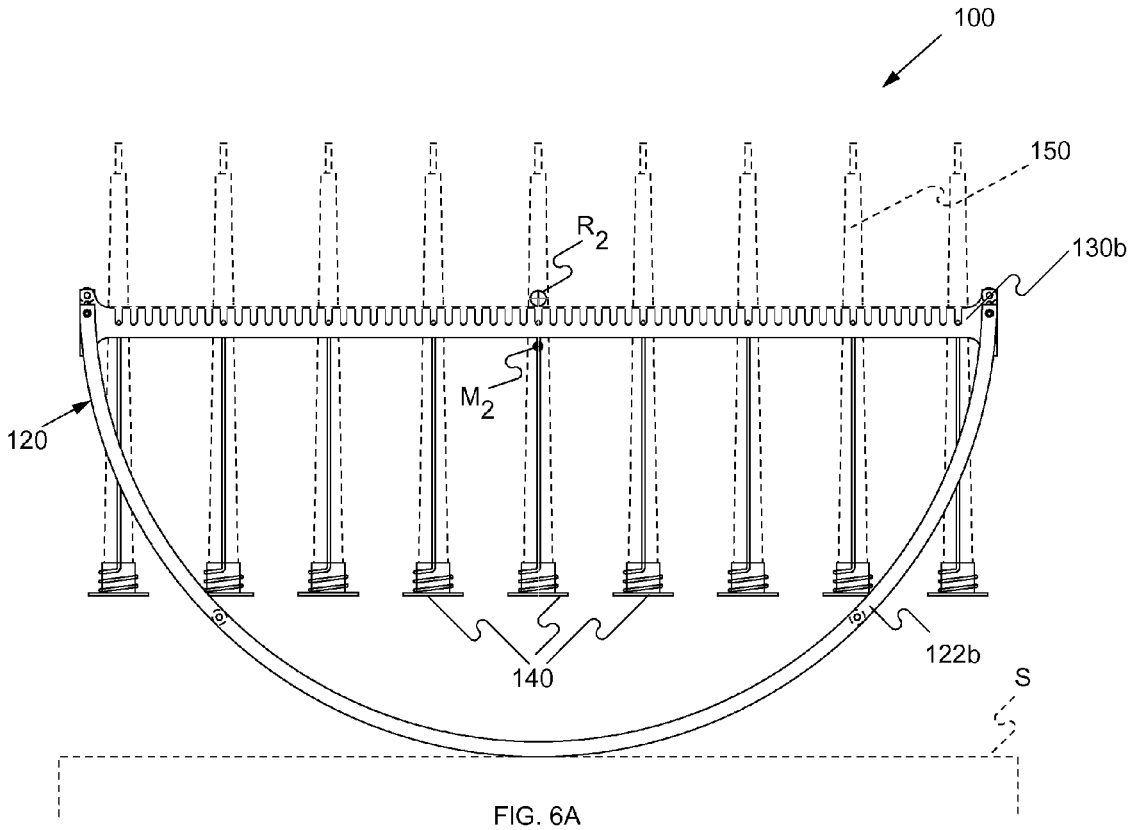
FIG. 6A is a front view of a candelabrum according to some aspects of the present disclosure.
Figure 6B:
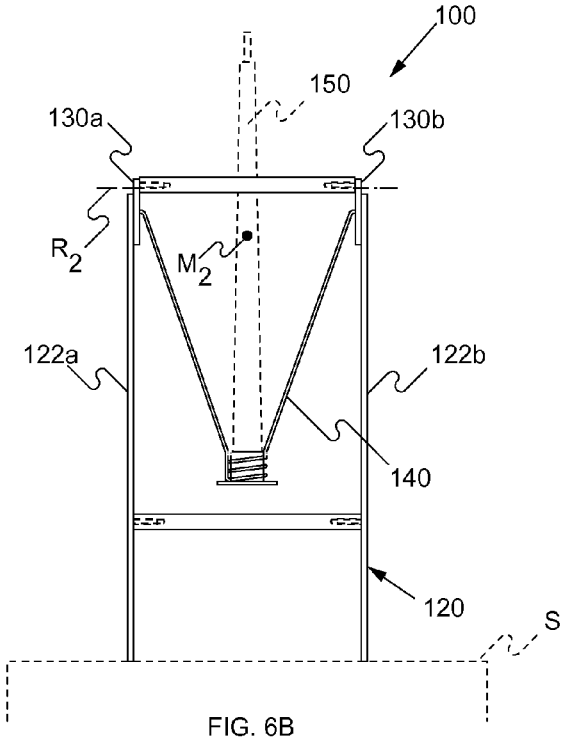
FIG. 6B is a side view of the candelabrum of FIG. 6A.
Figure 6C:
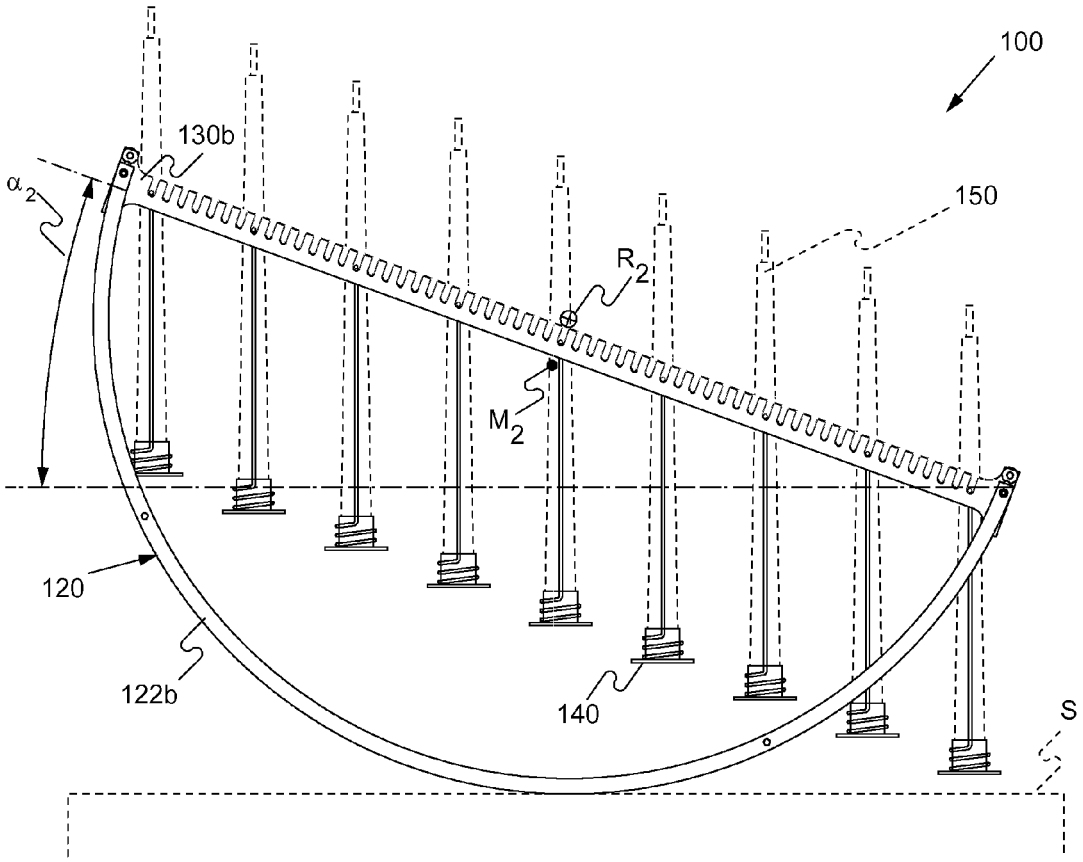
FIG. 6C is a front view of the candelabrum of FIG. 6A in an instantaneous rolled position according to some aspects of the present disclosure.

The candelabrum 10 has been described and shown in FIGS. 1A-5 as having a substantially circular frame assembly 20; however, various alternative shapes and sizes of a candelabrum are contemplated that include different shapes, sizes, orientations, and arrangements. For example, as shown in FIGS. 6A-6C, a candelabrum 100 includes a frame assembly 120, a pair of anchor beams 130*a,b*, and a plurality of candle supports 140 configured to hold a plurality of candles 150. The frame assembly 120 is similar to the frame assembly 20 described above; however, the shape of the frame assembly 120 is of a half circle as compared to the full circle shape of the frame assembly 20. The pair of anchor beams 130*a,b* and the plurality of candle supports 140 are the same as, or similar to, the pair of anchor beams 30*a,b* and the plurality of candle supports 40 described above in connection with FIGS. 1A-5. FIG. 6C illustrates the candelabrum 100 in an instantaneous rolled position similar to FIG. 5 described above in reference to candelabrum 10. The candelabrum 100 is in an instantaneous rolled position such that the pair of anchor beams 130 is at an angle of $\alpha_2$ with respect to horizontal.

The candelabrum 100 includes a center of mass $M_2$ that is below an axis of rotation $R_2$ of the candelabrum 100. Such an arrangement of the center of mass $M_2$ and the axis of rotation $R_2$ means that the candelabrum 100 is in a state of stable equilibrium when the center of mass $M_2$ is directly below the axis of rotation $R_2$ as shown, for example, in FIG. 6A. However, when the center of mass $M_2$ is not directly below the axis of rotation $R_2$ as shown, for example, in FIG. 6C, the candelabrum 100 is not in a state of stable equilibrium. Rather, the candelabrum 100 is in a state of motion and is configured to rock back and forth until the state of equilibrium is attained.

Figure 7A:
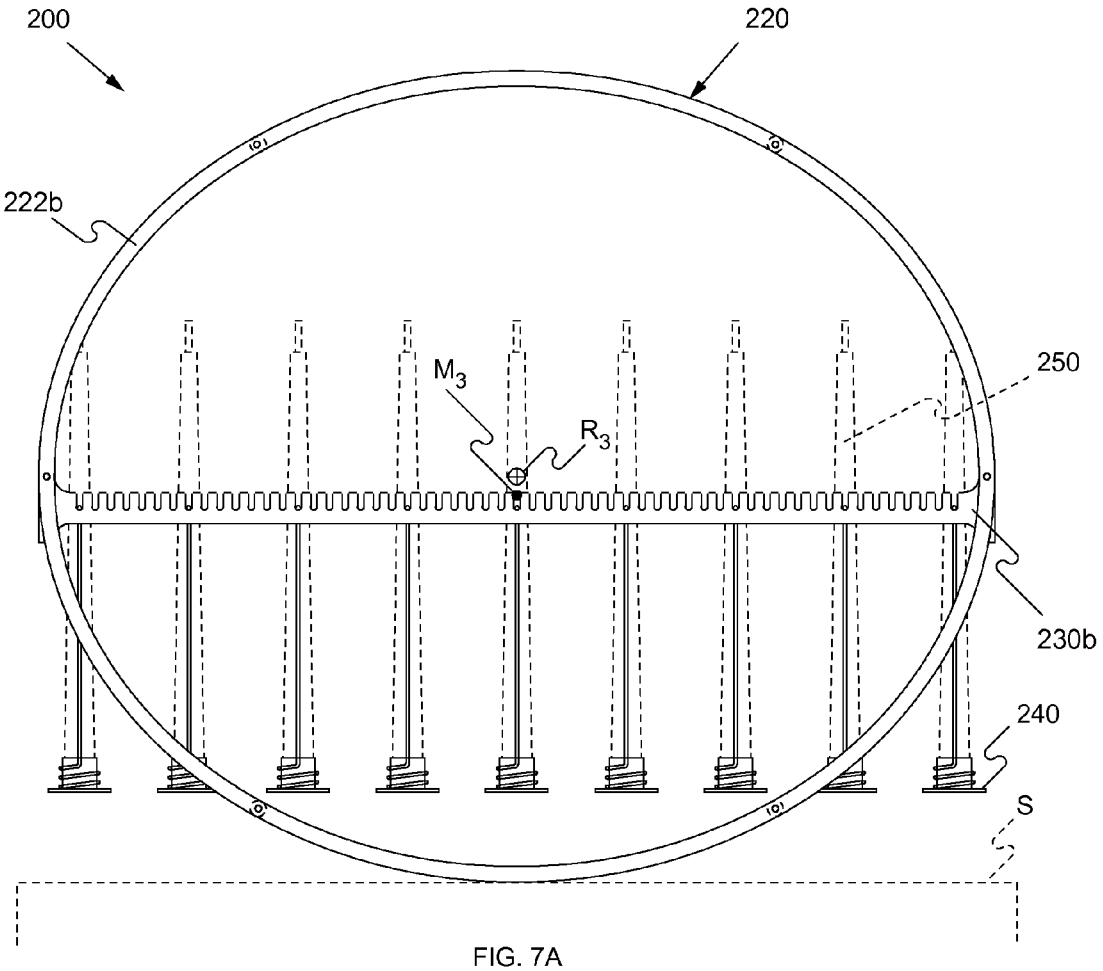
FIG. 7A is a front view of a candelabrum according to some aspects of the present disclosure.
Figure 7B:
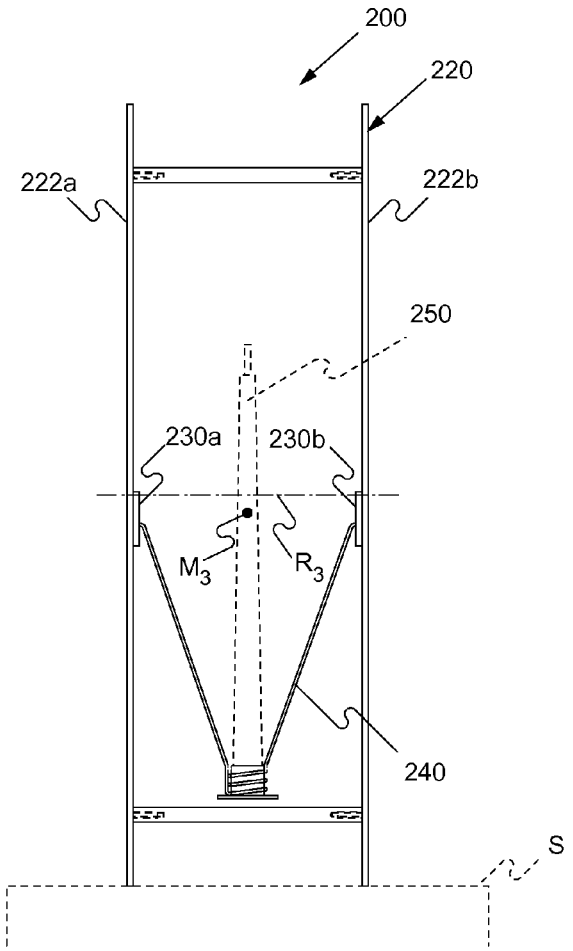
FIG. 7B is a side view of the candelabrum of FIG. 7A.
Figure 7C:
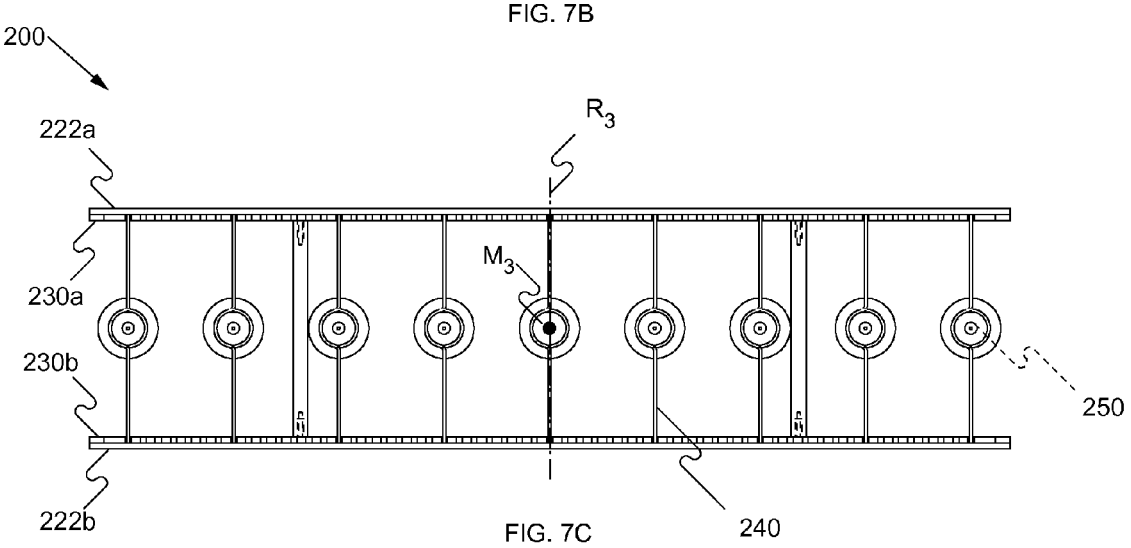
FIG. 7C is a top view of the candelabrum of FIG. 7A.

Referring to FIGS. 7A-7C, a candelabrum 200 includes a frame assembly 220, a pair of anchor beams 230*a,b*, and a plurality of candle supports 240 configured to hold a plurality of candles 250. The frame assembly 220 is similar to the frame assembly 20 described above in that the frame assembly 220 includes first and second frame members 222*a,b*, which are similar to the first and the second frame members 22*a,b*; however, the shape of each of the frame members 222*a,b* is of an ellipse as compared to the full circle shape of each of the frame members 22*a,b*. The pair of anchor beams 230*a,b* and the plurality of candle supports 240 are the same as, or similar to, the pair of anchor beams 30*a,b* and the plurality of candle supports 40 described above in connection with FIGS. 1A-5.

The candelabrum 200 includes a center of mass $M_3$ that is below an axis of rotation $R_3$ of the candelabrum 200. Such an arrangement of the center of mass $M_3$ and the axis of rotation $R_3$ means that the candelabrum 200 in a state of stable equilibrium when the center of mass $M_3$ is directly below the axis of rotation $R_3$ as shown, for example, in FIG. 7A.

Figure 8A:
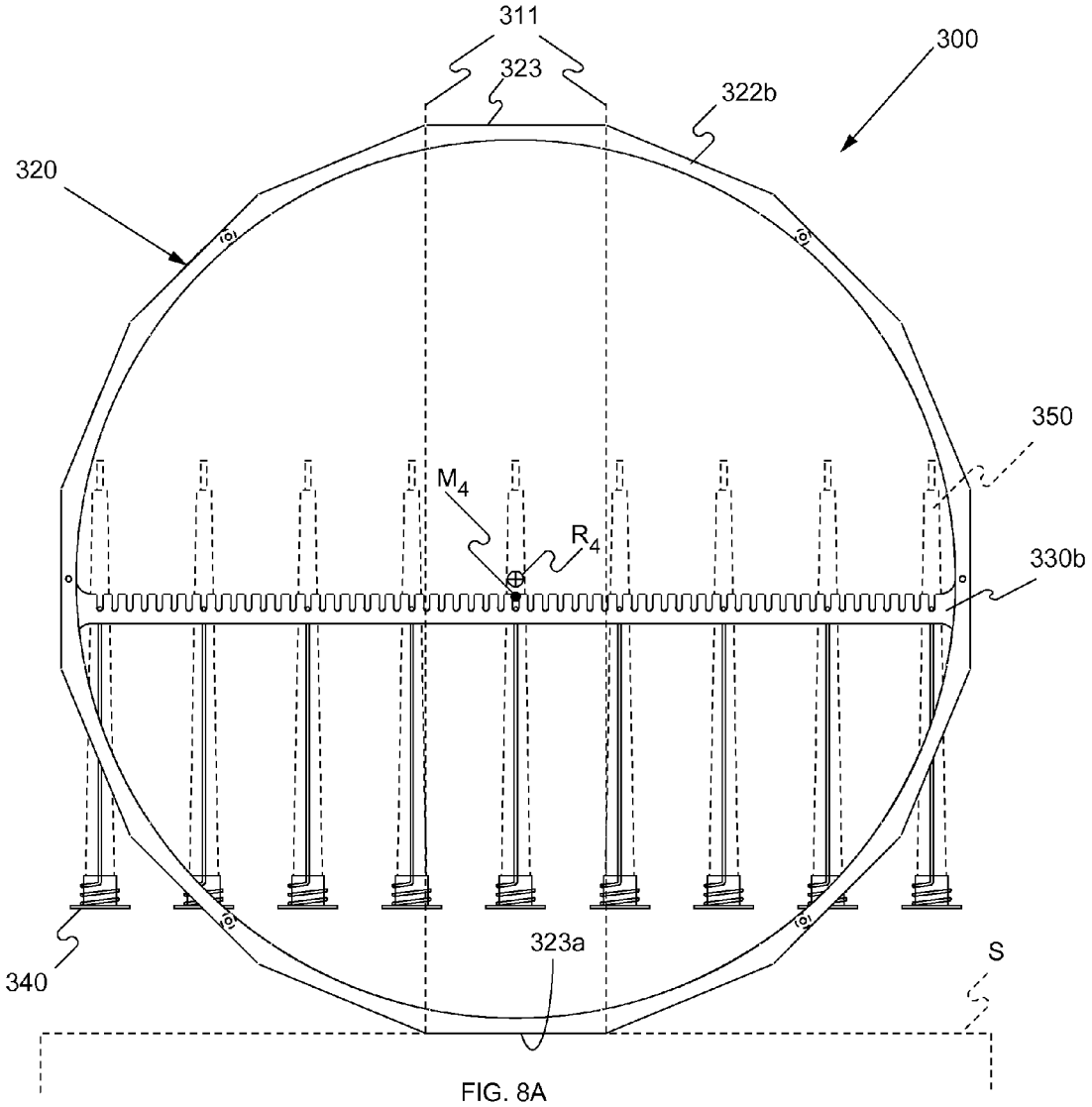
FIG. 8A is a front view of a candelabrum according to some aspects of the present disclosure.
Figure 8B:
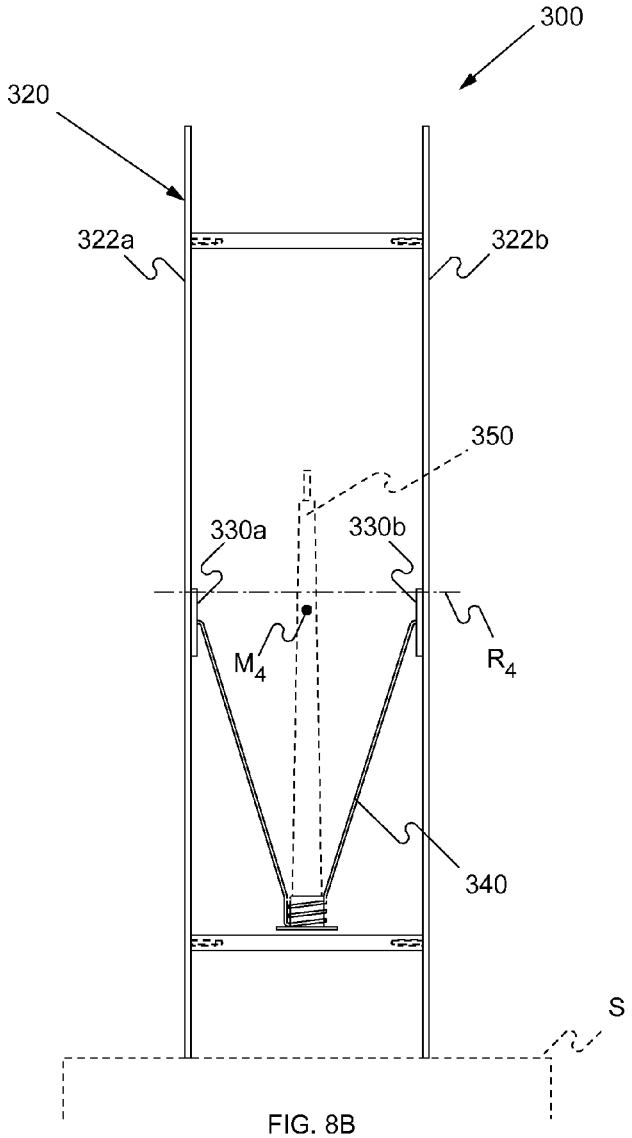
FIG. 8B is a side view of the candelabrum of FIG. 8A.
Figure 8C:
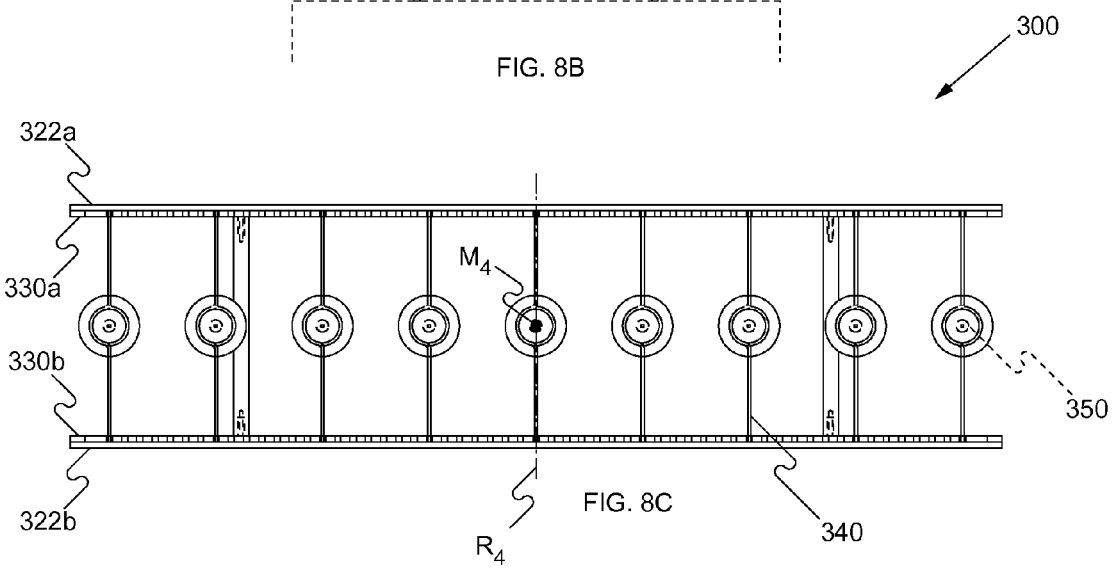
FIG. 8C is a top view of the candelabrum of FIG. 8A.

Referring to FIGS. 8A-8C, a candelabrum 300 includes a frame assembly 320, a pair of anchor beams 330*a,b*, and a plurality of candle supports 340 configured to hold a plurality of candles 350. The frame assembly 320 is similar to the frame assembly 20 described above; however, the shape of the frame assembly 320 is of a polygon as compared to the full circle shape of the frame assembly 20. The pair of anchor beams 330*a,b* and the plurality of candle supports 340 are the same as, or similar to, the pair of anchor beams 30*a,b* and the plurality of candle supports 40 described above in connection with FIGS. 1A-5.

The polygonal frame assembly 320 has a plurality of substantially flat or straight portions 323. Specifically, each frame member 322*a,b* of the frame assembly 320 includes a plurality of substantially flat portions 323. Each of the plurality of substantially flat portions 323 is configured to rest on a substantially flat surface, S, (e.g., a table). Depending on the distribution of the candle supports 340 along the length of the pair of anchor beams 330*a,b*, the candelabrum 300 can be at rest (i.e., a stable equilibrium position) while one of the flat portions 323 is in direct contact with a resting surface, S, (e.g., a table).

The candelabrum 300 is in a stable equilibrium as long as its center of mass $M_4$ lies between two imaginary lines 311. The two imaginary substantially vertical lines 311 emanate from the two ends of the substantially straight portion 323*a* in contact with the surface, S, on which the frame assembly 320 rests. The candelabrum 300 is in its stable equilibrium position as long as its center of mass $M_4$ lies between the two imaginary dashed lines 311, which it does as the candle supports 340 are evenly distributed along the length of the pair of anchor beams 330*a,b*.

Figure 9A:
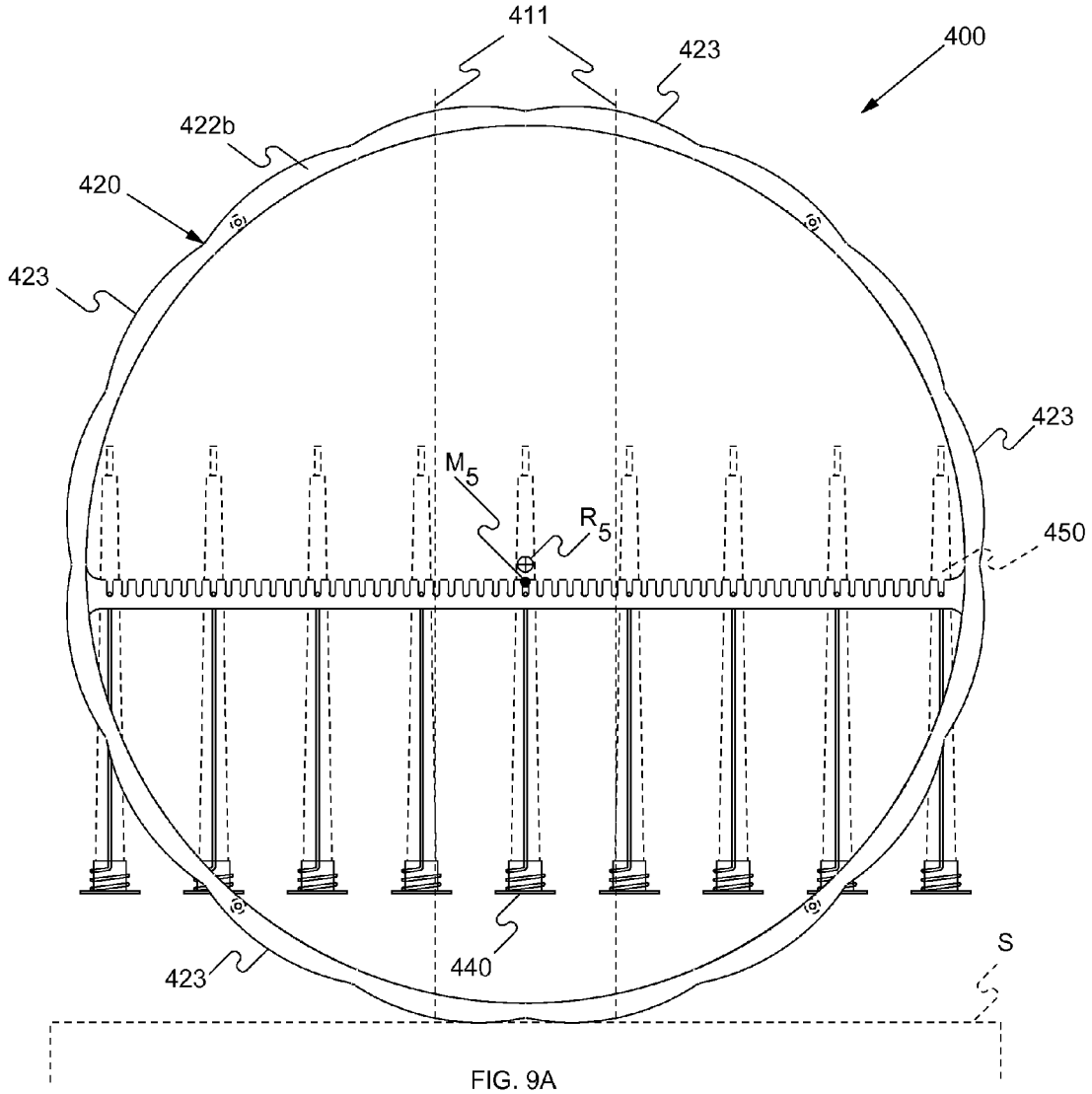
FIG. 9A is a front view of a candelabrum according to some aspects of the present disclosure.
Figure 9B:
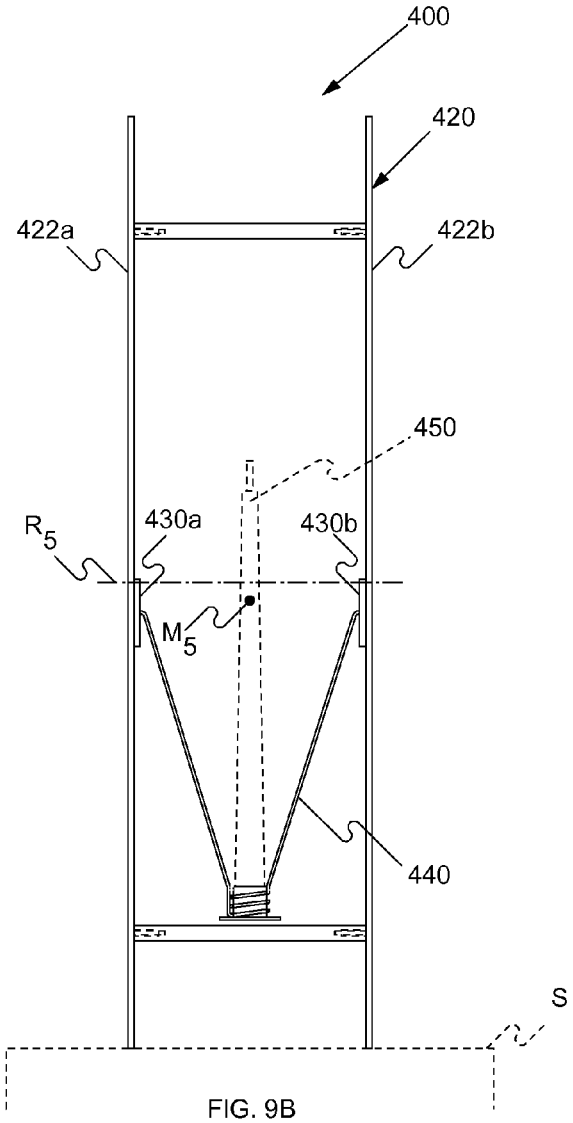
FIG. 9B is a side view of the candelabrum of FIG. 9A.
Figure 9C:
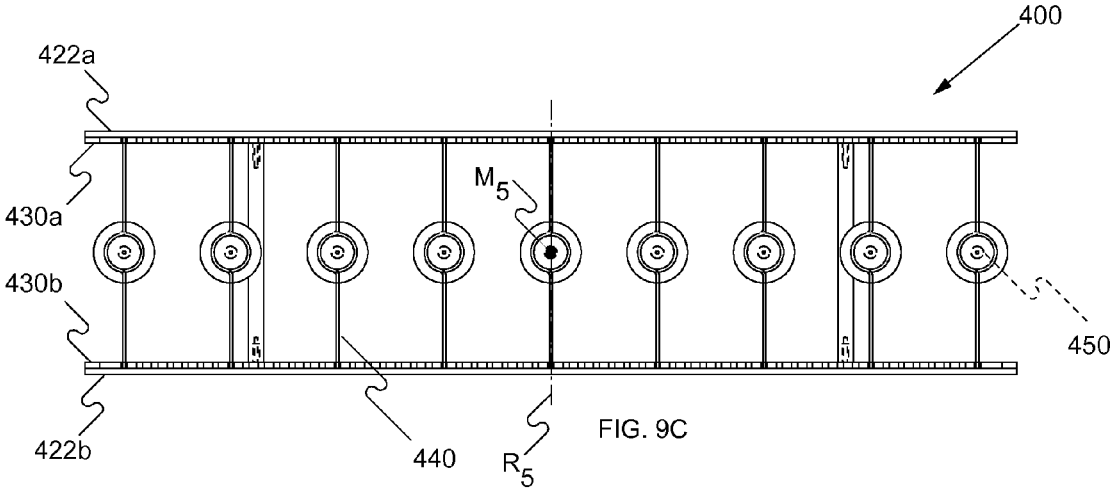
FIG. 9C is a top view of the candelabrum of FIG. 9A.

Referring to FIGS. 9A-9C, a candelabrum 400 includes a frame assembly 420, a pair of anchor beams 430*a,b*, and a plurality of candle supports 440 configured to hold a plurality of candles 450. The frame assembly 420 is similar to the frame assembly 320 described above; however, each portion 423 of the frame members 422*a,b* is substantially curved as compared to the substantially flat portions 323 of the frame members 322*a,b*. The pair of anchor beams 430*a,b* and the plurality of candle supports 440 are the same as, or similar to, the pair of anchor beams 30*a,b* and the plurality of candle supports 40 described above in connection with FIGS. 1A-5. Alternatively, each of the portions 423 of the frame members 422*a,b* can be other shapes, such as, for example, triangular, polygonal, partially flat, flat, substantially flat, partially curved, substantially curved, curved in more than one direction, or a combination thereof.

The candelabrum 400 is in a stable equilibrium as long as its center of mass $M_5$ lies between two imaginary lines 411. The two imaginary substantially vertical lines 411 emanate from the two points of adjacent portions 423 of the frame members 422*a,b* that are in direct contact with a resting surface, S, (e.g., a table) as shown in, for example, FIG. 9A. The candelabrum 400 is in its stable equilibrium position as long as its center of mass $M_5$ lies between the two imaginary dashed lines 411, which it does as the candle supports 440 are evenly distributed along the length of the pair of anchor beams 430*a,b*.

Figure 10A:
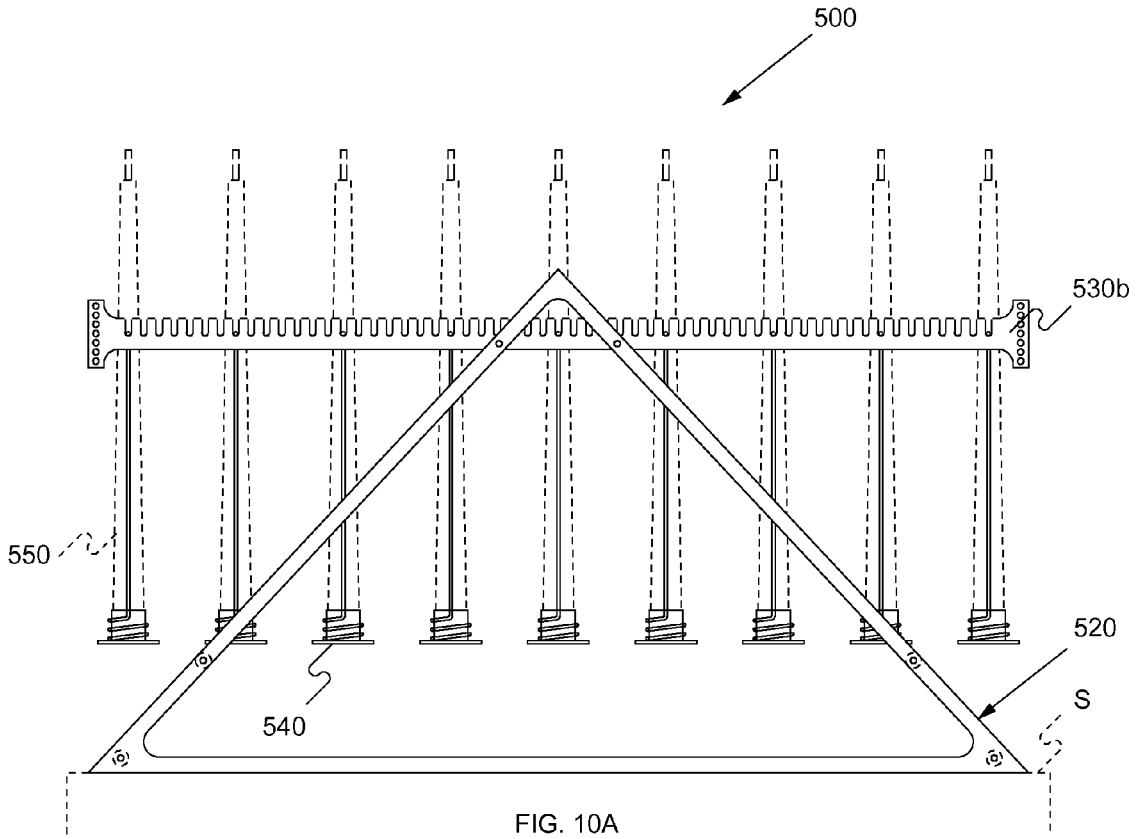
FIG. 10A is a front view of a candelabrum according to some aspects of the present disclosure.
Figure 10B:
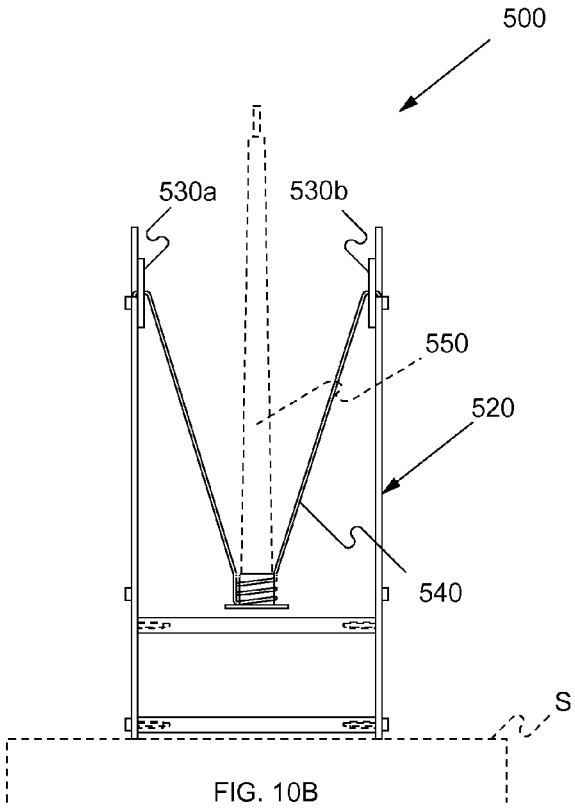
FIG. 10B is a side view of the candelabrum of FIG. 10A.
Figure 10C:
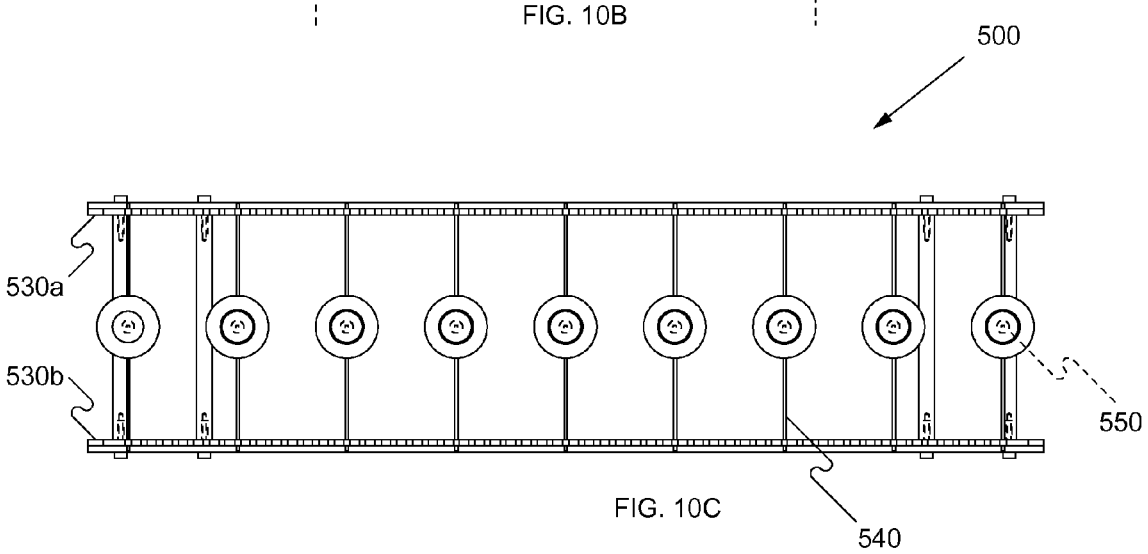
FIG. 10C is a top view of the candelabrum of FIG. 10A.

Referring to FIGS. 10A-10C, a candelabrum 500 includes a frame assembly 520, a pair of anchor beams 530*a,b*, and a plurality of candle supports 540 configured to hold a plurality of candles 550. The frame assembly 520 has three straight sides in the shape of a triangle. The pair of anchor beams 530*a,b* and the plurality of candle supports 540 are the same as, or similar to, the pair of anchor beams 30*a,b* and the plurality of candle supports 40 described above in connection with FIGS. 1A-5; however, the pair of anchor beams 530*a,b* is coupled to the frame assembly 520 at a generally central portion of the pair of anchor beams 530*a,b* as compared to being coupled to the frame assembly 520 at or near the ends of each of the pair of anchor beams 530*a,b*. The frame assembly 520 contacts its resting surface, S, along a straight line, which results in the center of rotation of the candelabrum 500 being at infinity.

Figure 11A:
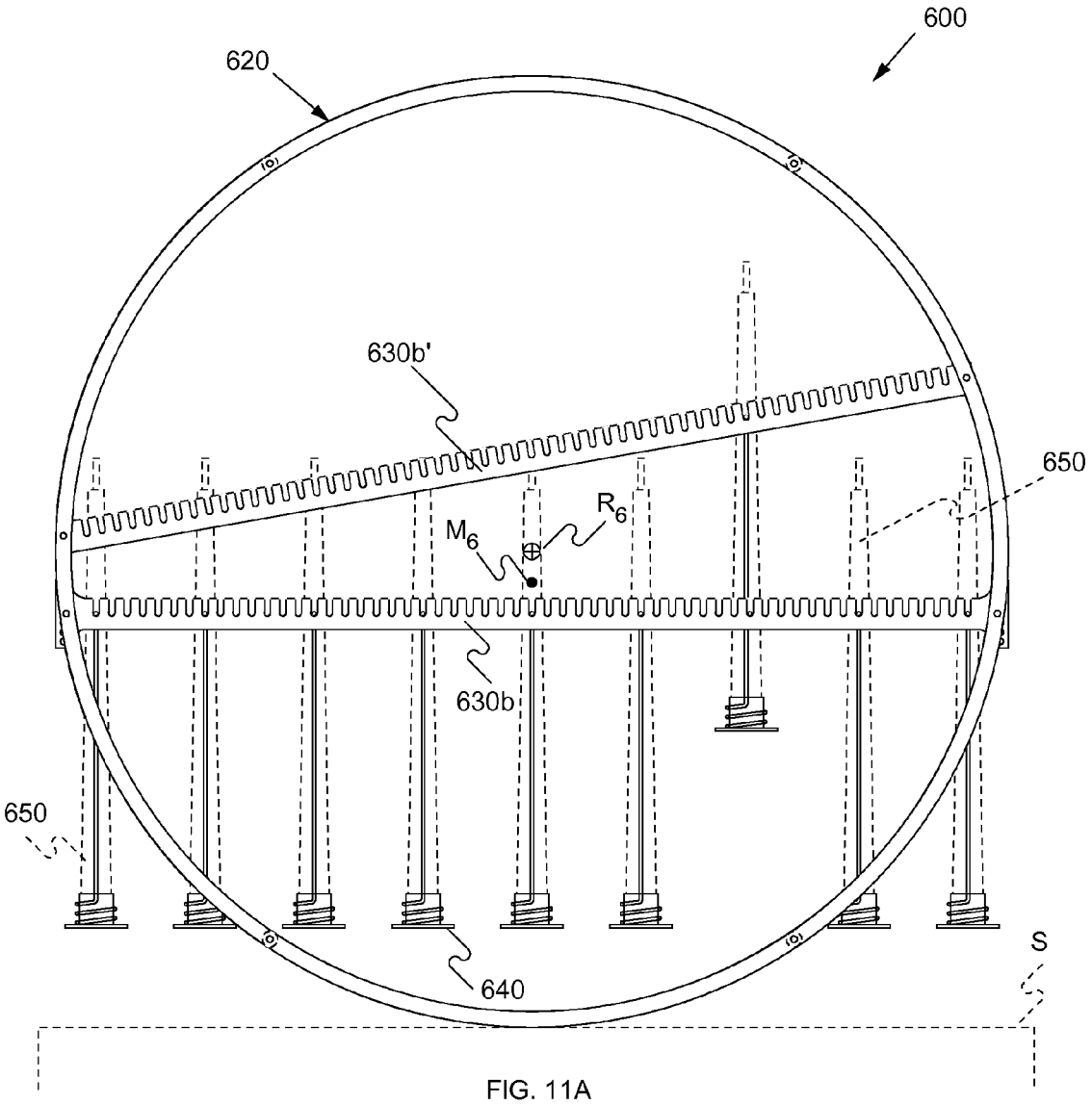
FIG. 11A is a front view of a candelabrum according to some aspects of the present disclosure.
Figure 11B:
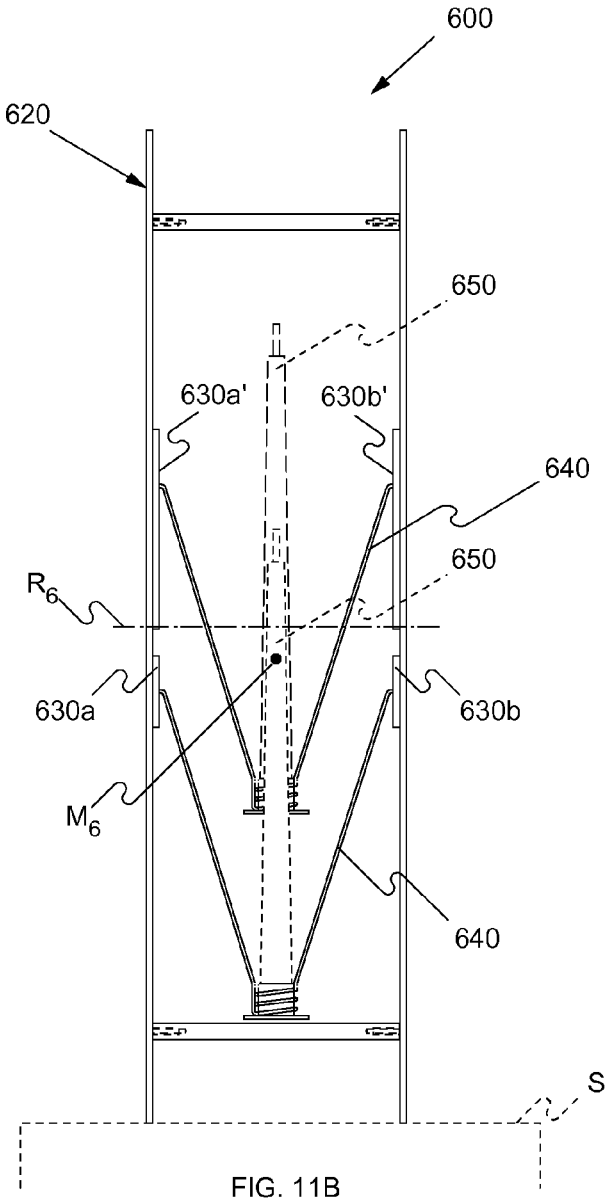
FIG. 11B is a side view of the candelabrum of FIG. 11A.
Figure 11C:
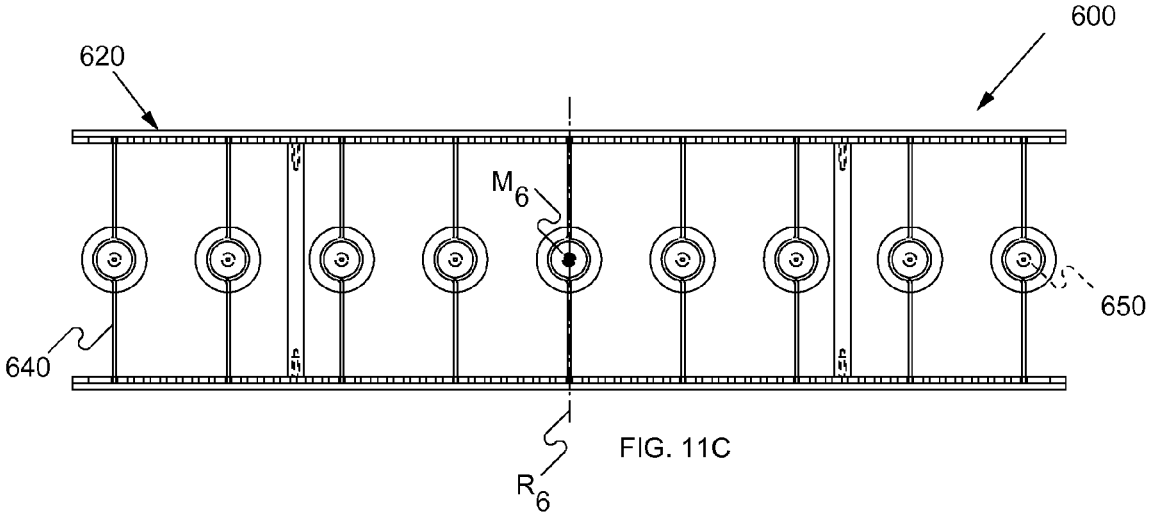
FIG. 11C is a top view of the candelabrum of FIG. 11A.

Referring to FIGS. 11A-11C, a candelabrum 600 is similar to the candelabrum 10 in that the candelabrum 600 includes a frame assembly 620, a first pair of anchor beams 630*a,b*, and a plurality of candle supports 640 configured to hold a plurality of candles 650 that are the same as, or similar to, the frame assembly 20, the pair of anchor beams 30*a,b*, and the plurality of candle supports 40. Additionally, the candelabrum 600 includes a second pair of anchor beams 630*a',b'*, which are the same as, or similar to, the first pair of anchor beams 630*a,b*, but is attached to the frame assembly 620 in a different orientation. Thus, two pairs of anchor beams 630*a,b* and 630*a',b'* are provided in a single frame assembly 620 to increase the number of positions for hanging the plurality of candle supports 640 as compared to the candelabrum 10.

The candelabrum 600 includes a center of mass $M_6$ that is below an axis of rotation $R_6$ of the candelabrum 600. Such an arrangement of the center of mass $M_6$ and the axis of rotation $R_6$ means that the candelabrum 600 is in a state of stable equilibrium when the center of mass $M_6$ is directly below the axis of rotation $R_6$ as shown, for example, in FIG.

11A. The center of mass $M_6$ can be adjusted vertically upward by, for example, coupling more candle supports 640 and candles 650 to the second pair of anchor beams 630'.

Figure 12A:
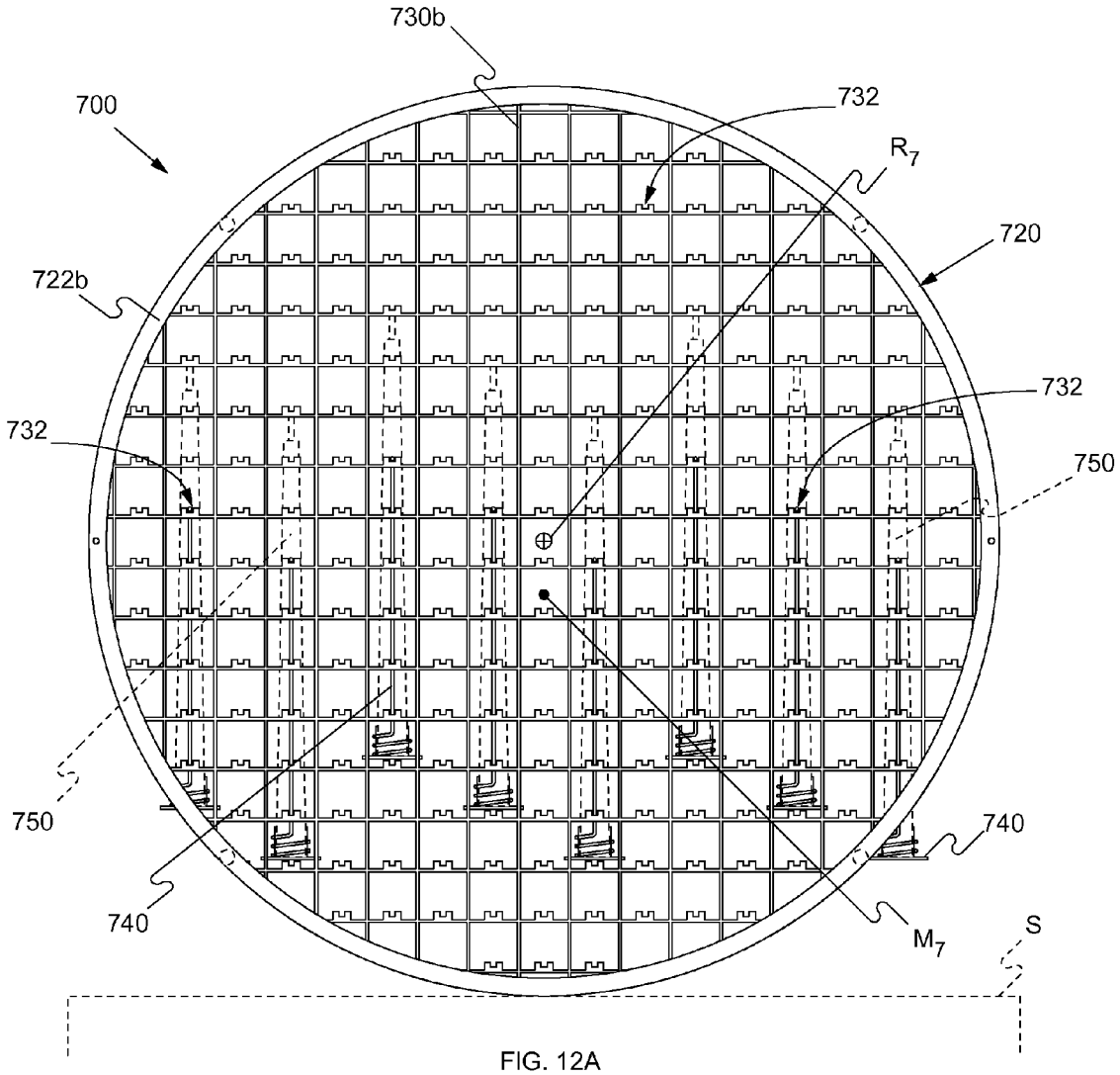
FIG. 12A is a front view of a candelabrum according to some aspects of the present disclosure.
Figure 12B:
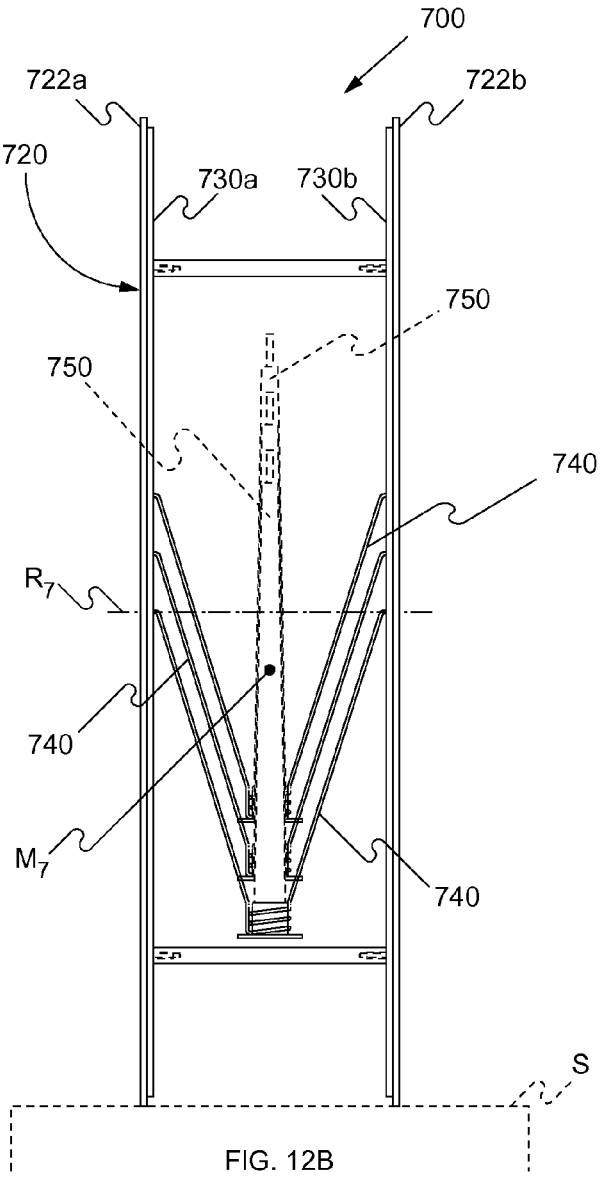
FIG. 12B is a side view of the candelabrum of FIG. 12A.
Figure 12C:
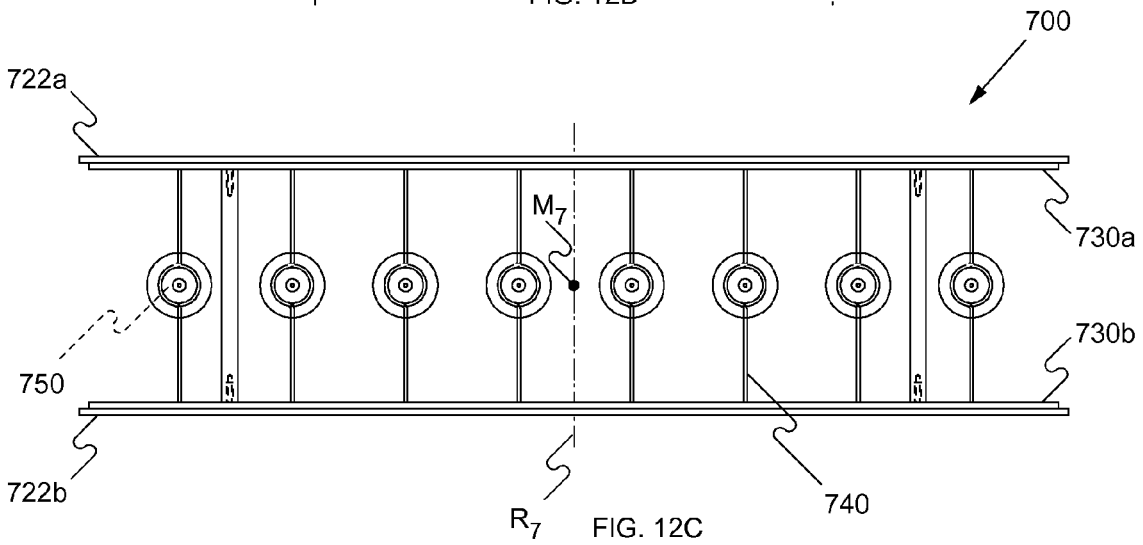
FIG. 12C is a top view of the candelabrum of FIG. 12A.

Referring to FIGS. 12A-12C, a candelabrum 700 includes a frame assembly 720, a pair of anchor grids 730*a,b*, and a plurality of candle supports 740 configured to hold a plurality of candles 750. The frame assembly 720 includes first and second frame members 722*a,b* which are the same as, or similar to, the first and the second frame members 22*a,b*. Similarly, the plurality of candle supports 740 are the same as, or similar to, the plurality of candle supports 40. Each of the anchor grids 730*a,b* is generally a mesh of material, such as, for example, wire or string, etc. Each of the anchor grids 730*a,b* has a plurality of attachment points or pivot points 732 configured to be coupled with the plurality of candle supports 740 in a pivotal relationship. Alternatively, in lieu of the attachment points 732, the anchor grids 730*a,b* can be formed with a tight grid structure such that candle supports coupled thereto are substantially prevented from sliding laterally within the various cells of the anchor grids 730*a,b*.

The anchor grids 730*a,b* are attached to an outer surface of the frame assembly 720 via a weld connection, a glue connection, a screw connection, etc., or a combination thereof. To install, for example, the candle support 740*a*, the arms 742*a,b* of the candle support 740*a* can be pinched and/or squeezed together to provide sufficient clearance for the pivot portions 743*a,b* to be positioned through and between the anchor grids 730*a,b* and the frame assembly 720. Release of the arms 742*a,b* allows the candle support 740*a* to spring back into its unpinched shape thereby engaging the anchor grids 730*a,b* as shown in FIGS. 12A-12C.

The candelabrum 700 includes a center of mass $M_7$ that is below an axis of rotation $R_7$ of the candelabrum 700. Such an arrangement of the center of mass $M_7$ and the axis of rotation $R_7$ means that the candelabrum 700 is in a state of stable equilibrium when the center of mass $M_7$ is directly below the axis of rotation $R_7$ as shown, for example, in FIG. 12A.

Each of the first and the second frame members 722*a,b* defines an interior area, which is circular corresponding to the circular shape of the frame members 722*a,b*. The first one of the pair of anchor grids 730*a* is coupled to the first frame member 722*a* such that substantially all of the interior area defined by the first frame member 722*a* is covered by the first anchor grid 730*a*. Similarly, the second one of the pair of anchor grids 730*b* is coupled to the second frame member 722*b* such that substantially all of the interior area defined by the second frame member 722*b* is covered by the second anchor grid 730*b*.

While the anchor grids 730*a,b* are shown and described as covering the entire side area of the frame assembly 720, it is contemplated that the anchor grids can cover only part of the sides of the frame assembly 720. Alternatively or additionally, a portion of the anchor grids 730*a,b* can extend beyond frame assembly 720 (not shown).

Figure 13A:
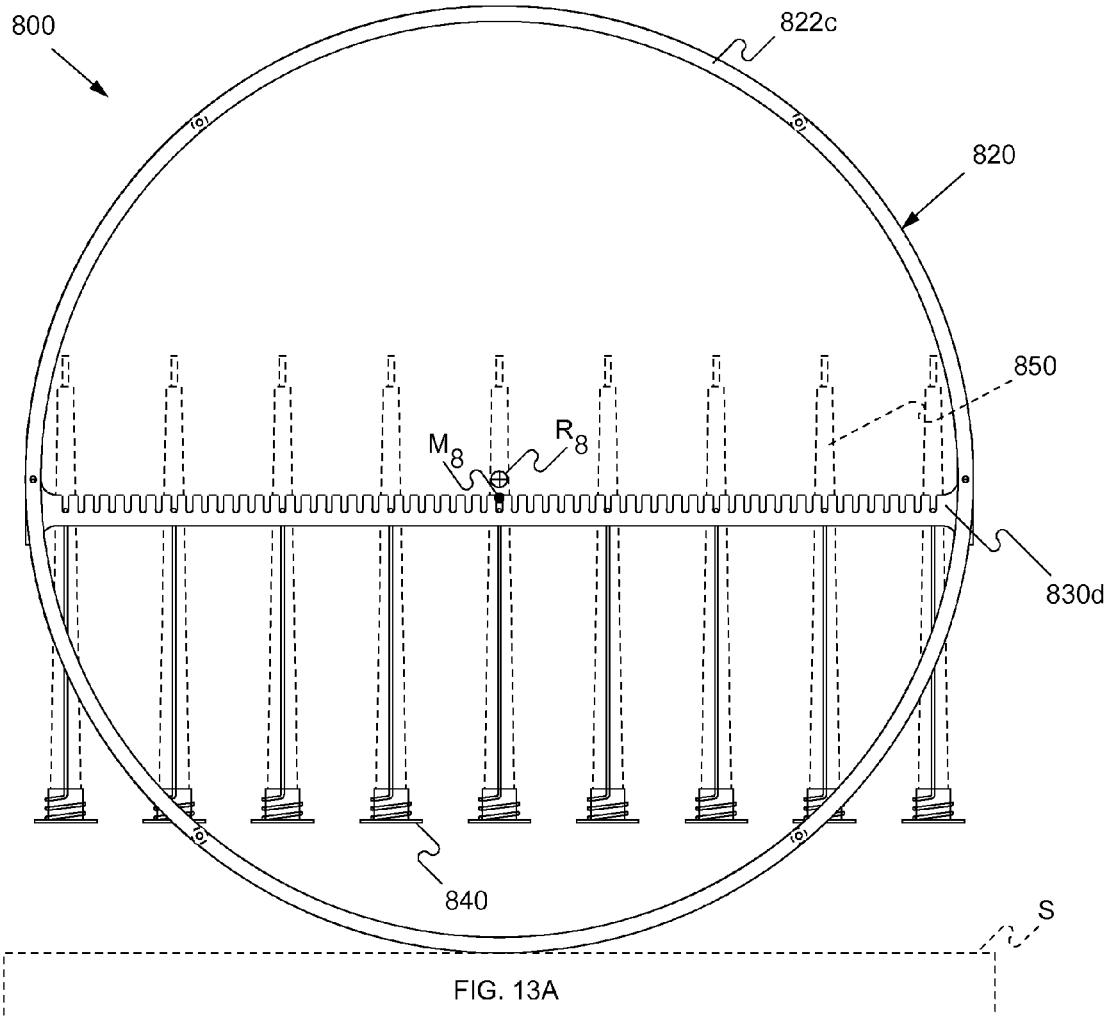
FIG. 13A is a front view of a candelabrum according to some aspects of the present disclosure.
Figure 13B:
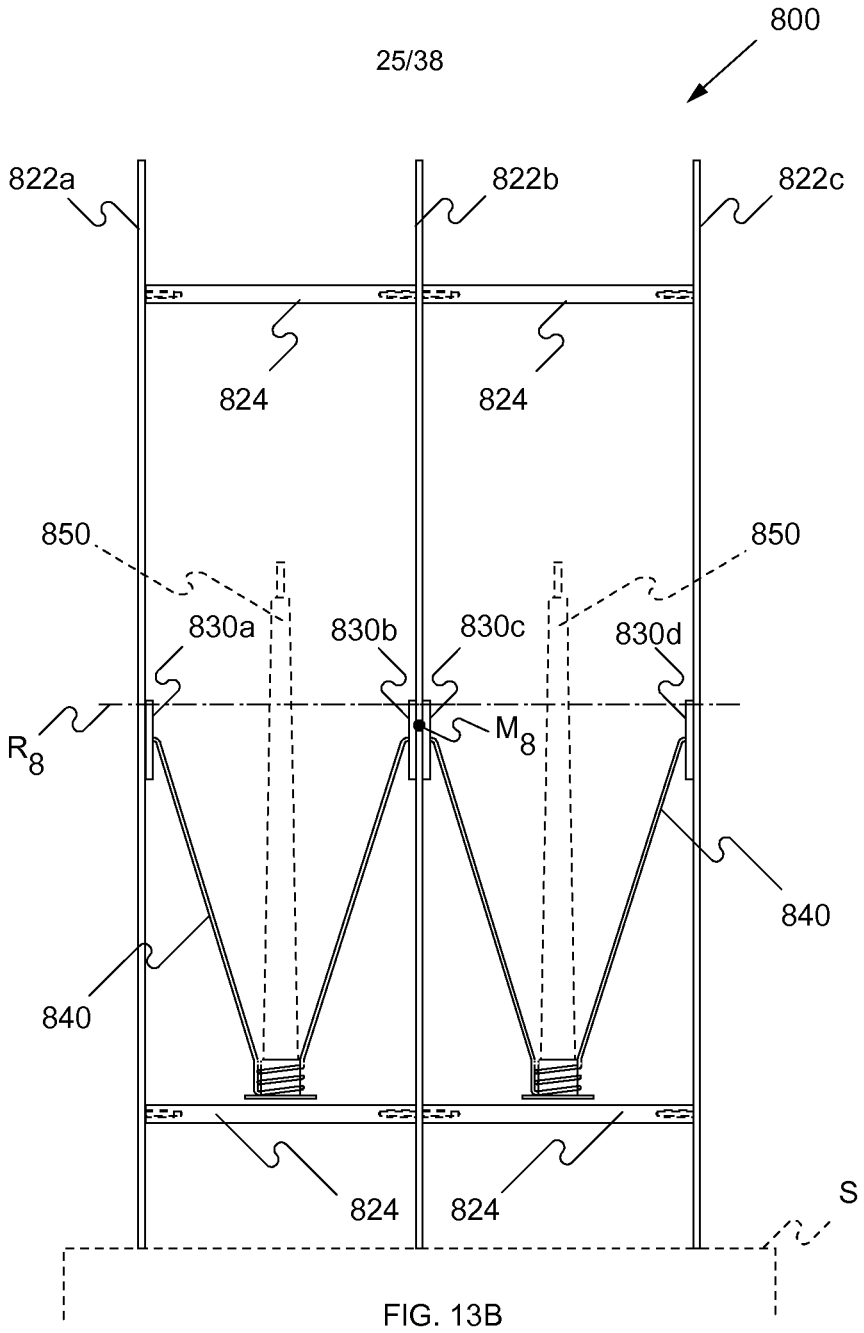
FIG. 13B is a side view of the candelabrum of FIG. 13A.
Figure 13C:
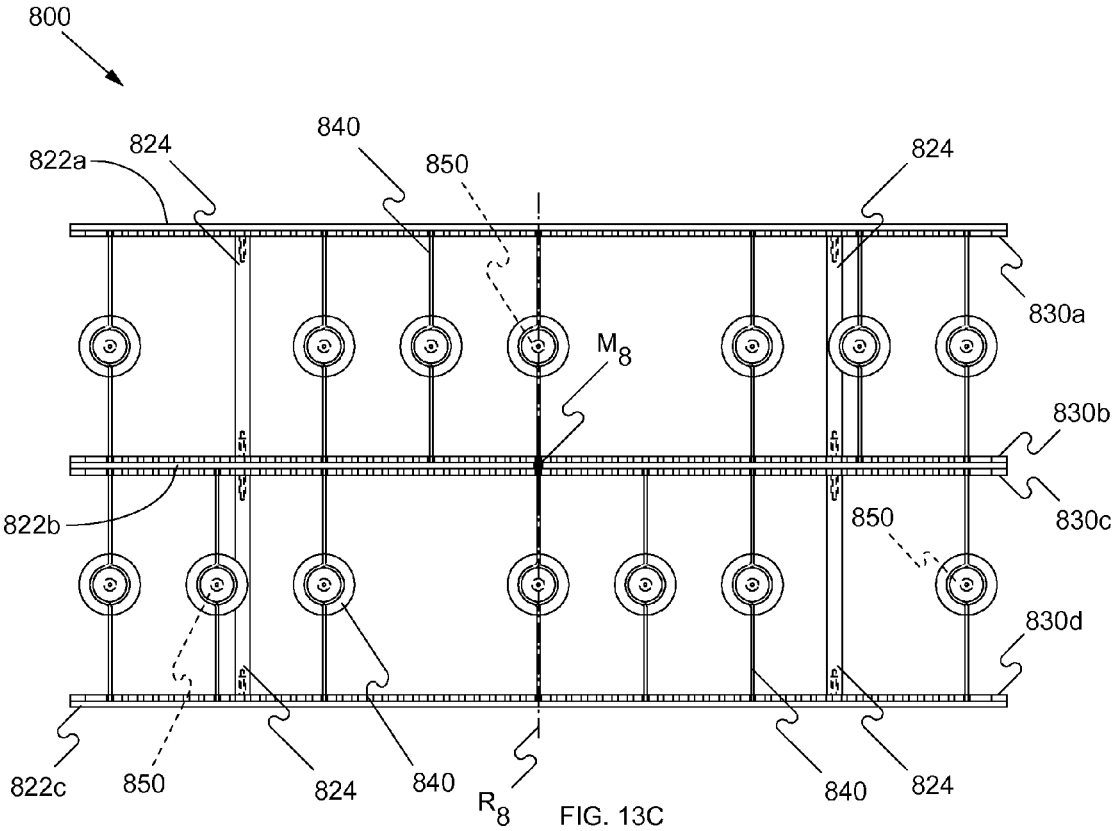
FIG. 13C is a top view of the candelabrum of FIG. 13A.

Referring to FIGS. 13A-13C, a candelabrum 800 includes a frame assembly 820, two pairs of anchor beams 830*a,b*, and 830*c,d*, and a plurality of candle supports 840 configured to hold a plurality of candles 850. Each of the pairs of anchor beams 830*a,b* and 830*c,d* and the plurality of candle supports 840 are the same as, or similar to, the pair of anchor beams 30*a,b* and the plurality of candle supports 40. The frame assembly 820 includes three frame members 822*a,b,c*, wherein the second frame member 822*b* is positioned between the first and the third frame members 822*a,c*. The first and the second frame members 822*a,b* are coupled together via one or more cross members 824 in the same, or similar, manner as the frame members 22*a,b* are coupled. Additionally, the second and the third frame members 822*b,c* are coupled together via one or more additional cross members 824. The candelabrum 800 can be referred to as a double-wide candelabrum as compared to the candelabrum 10. In some alternatives, only two of the frame members 822*a,b,c* are in contact with a surface, S, on which the candelabrum 800 rests. In such alternatives, for example, the second frame member 822*b* can have a relatively smaller diameter (not shown) such that only the first and the third frame members 822*a,c* are configured to contact the surface, S, on which the candelabrum 800 rests.

The candelabrum 800 includes a center of mass Mg that is below an axis of rotation $R_8$ of the candelabrum 800. Such an arrangement of the center of mass $M_8$ and the axis of rotation $R_8$ means that the candelabrum 800 is in a state of stable equilibrium when the center of mass $M_8$ is directly below the axis of rotation $R_8$ as shown, for example, in FIG. 13A.

Referring to FIGS. 14A-14E, a candelabrum 900 includes a frame assembly 920, a pair of anchor beams 930*a,b*, and a plurality of candle supports 940 and 940' configured to hold a plurality of candles 950. The frame assembly 920, the pair of anchor beams 930*a,b*, and the plurality of candle supports 940 are the same as, or similar to, the frame assembly 20, the pair of anchor beams 30*a,b*, and the plurality of candle supports 40. The pair of anchor beams 930*a,b* includes a plurality of apertures 934 instead of a plurality of slots (e.g., slots 34*a,b* shown in FIG. 3A).

Figure 14D:
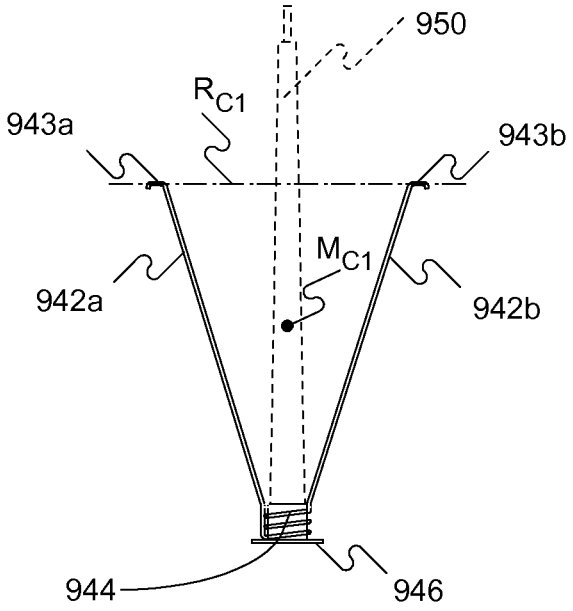
FIG. 14D is a side view of a first candle support of the candelabrum of FIG. 14A.
Figure 14E:
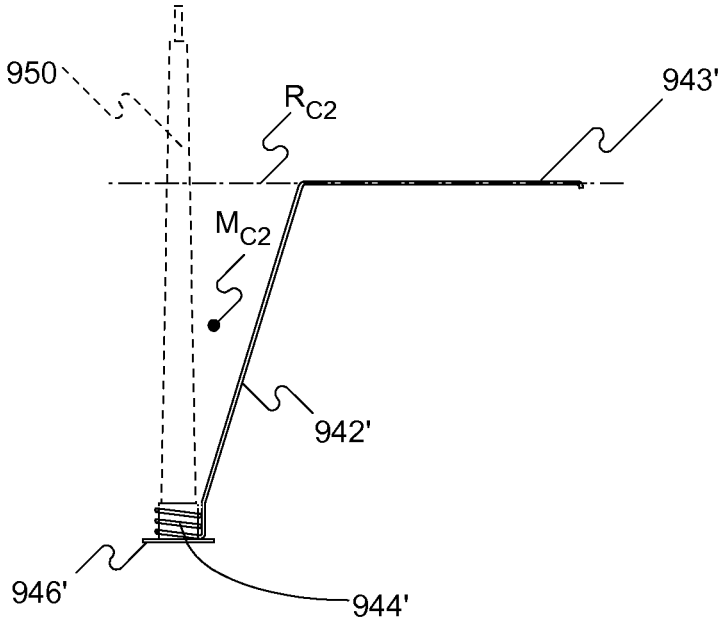
FIG. 14E is a side view of a second candle support of the candelabrum of FIG. 14A.

As shown in FIGS. 14D and 14E, the candle supports 940' are cantilevered supports that are similar to the candle supports 940 but each only includes one arm 942', one pivot portion 943', an attachment portion 944', and a base 946' as compared to the candle supports 940 that are the same as the candle supports 40 and include a pair of arms 942*a,b*, a pair of pivot portions 943*a,b*, an attachment portion 944, and a base 946. Additionally, the single pivot portion 943' is relatively longer in length as compared to the length of the pivot portions 943*a,b*. The pivot portion 943' is longer such that it can extend through and be coupled to both of the anchor beams 930*a,b* via two corresponding apertures 934 (i.e., one aperture in each of the anchor beams 930*a,b*). Thus, the pivot portion 943' is the same in length or slightly longer in length (e.g., 1-10% longer) than the length of the cross members 924.

A center of mass $M_{C2}$ of the combination of the candle 950 and the candle support 940' is designed to be lower than an axis of rotation $R_{C2}$ or the pivot point of the candle support 940', which is similar to how the center of mass $M_{C1}$ of the combination of the candle 950 and the candle support 940 is designed to be lower than the axis of rotation $R_{C1}$ of the candle support 940. Such locations of the center of mass $M_{C1}$ and $M_{C2}$ aid in maintaining stability of each candle 950 when installed in the candelabrum 900.

The position of the pair of anchor beams 930*a,b* in relation to the frame assembly 920 and the distribution of the candle supports 940 and the cantilevered candle supports 940' in relation to the pair of anchor beams 930*a,b* can be adjusted to move the center of mass $M_9$ of the candelabrum 900 both vertically and horizontally. This center of mass $M_9$ can be adjusted such that it is positioned horizontally (as viewed from the side view in FIG. 14B) between first and second frame members 922*a,b* of the frame assembly 920 and vertically (as viewed from the front view in FIG. 14A) below a center of rotation $R_9$ of the candelabrum 900 to main stability of the candelabrum 900.

Figure 15:
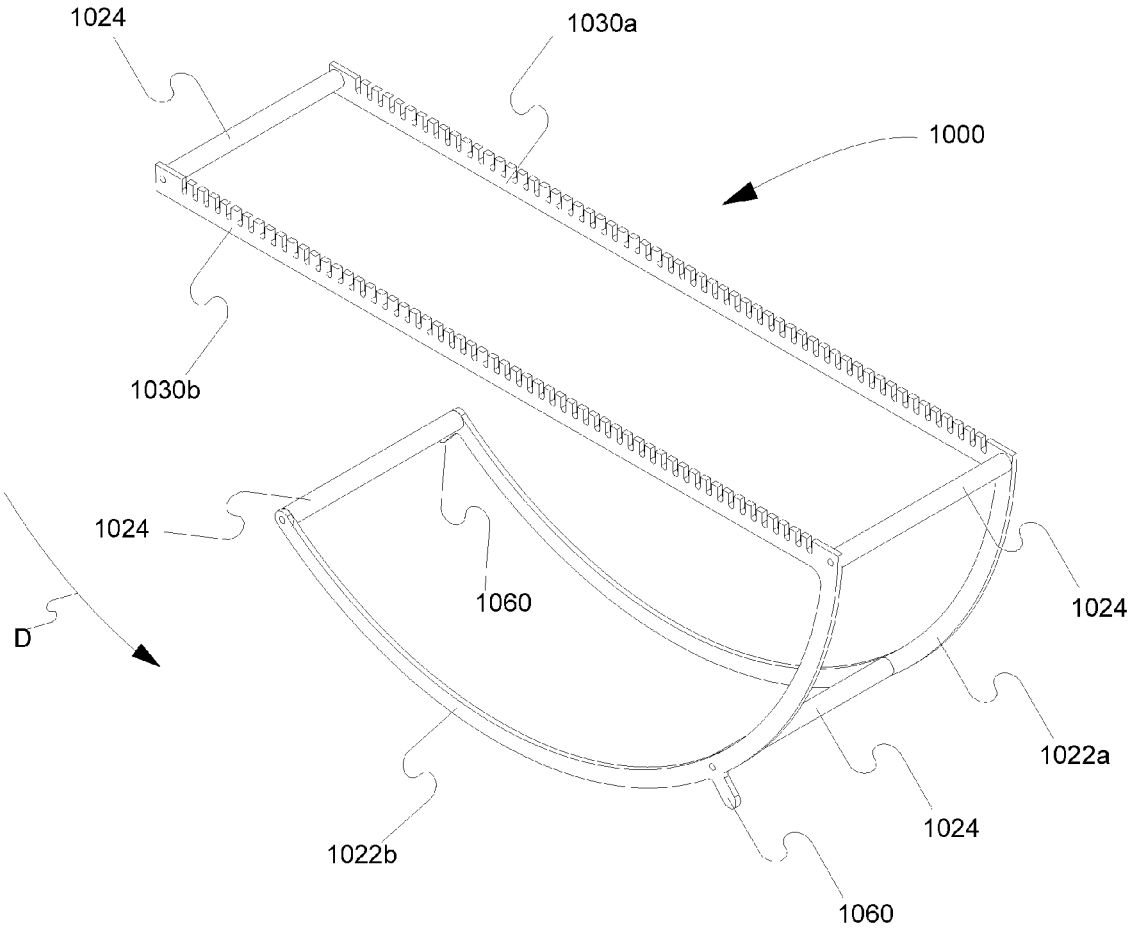
FIG. 15 is a perspective view of a candelabrum according to some aspects of the present disclosure.

Referring to FIG. 15, a candelabrum 1000 includes a first frame member 1022*a*, a second frame member 1022*b*, a first anchor beam 1030*a*, a second anchor beam 1030*b*, one or more cross members 1024, and stoppers 1060. The first and second frame members 1022*a,b* are coupled via the cross members 1024 in the same, or similar, manner as the frame members 22*a,b* are coupled via the cross members 24 as described above. The first and the second anchor beams 1030*a,b* are attached to, or integral with, the first and the second frame members 1022*a,b*, respectively. As shown in FIG. 15, the anchor beams 1030*a,b* are integral with the frame members 1022*a,b* and thus cannot be adjusted vertically in the manner described above in connection with the pair of anchor beams 30*a,b*.

The stoppers 1060 are attached to the frame members 1022*a,b* to aid in preventing the candelabrum from over-rotating during installation of one or more candles (not shown) and/or candle supports (not shown). For example, if one candle support is installed at the leftmost position of the anchor beams 1030*a,b*, the weight of the candle support and the candle therein would cause a shift in the center of mass of the candelabrum 1000 that would cause the candelabrum 1000 to rotate in the direction of arrow D. In some implementations, if the installed weight is large enough, the candelabrum can become unstable and tip over without the presence of the stoppers, which act to resist the over-rotation caused by the unevenly distributed load on the anchor beams 1030*a,b*. That is, the stoppers 1060 aid in preventing the candelabrum 1000 from tipping during installation of candle supports and/or candles.

Figure 16:
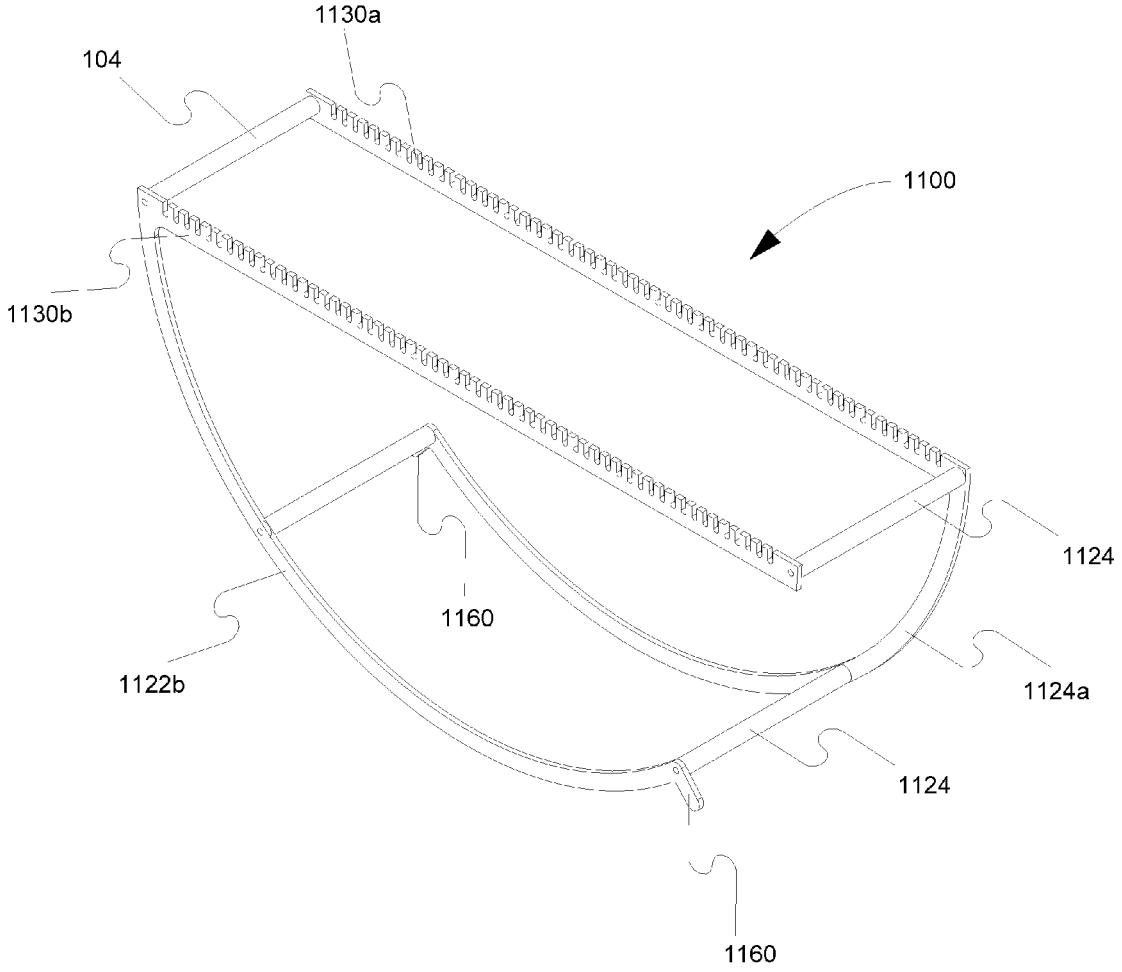
FIG. 16 is a perspective view of a candelabrum according to some aspects of the present disclosure.

The frame members 1022*a,b* are generally symmetrical about a center of the candelabrum 1000. Alternatively, one of the frame members can be rotated 180 degrees as shown in FIG. 16. Similar to the candelabrum 1000, a candelabrum 1100 includes a first frame member 1122*a*, a second frame member 1122*b*, a first anchor beam 1130*a*, a second anchor beam 1130*b*, one or more cross members 1124, and stoppers 1160. The only difference between the candelabrums 1000 and 1100, is that the first and the second frame members 1122*a,b* are in a different orientation. The stoppers 1160 aid in stabilizing the candelabrum 1100 during loading in the same manner as described in connection with the stoppers 1060 of FIG. 15. The candelabrums 1000 and 1100 can further include one or more candle supports (not shown) with one or more candles (not shown) therein.

Figure 17:
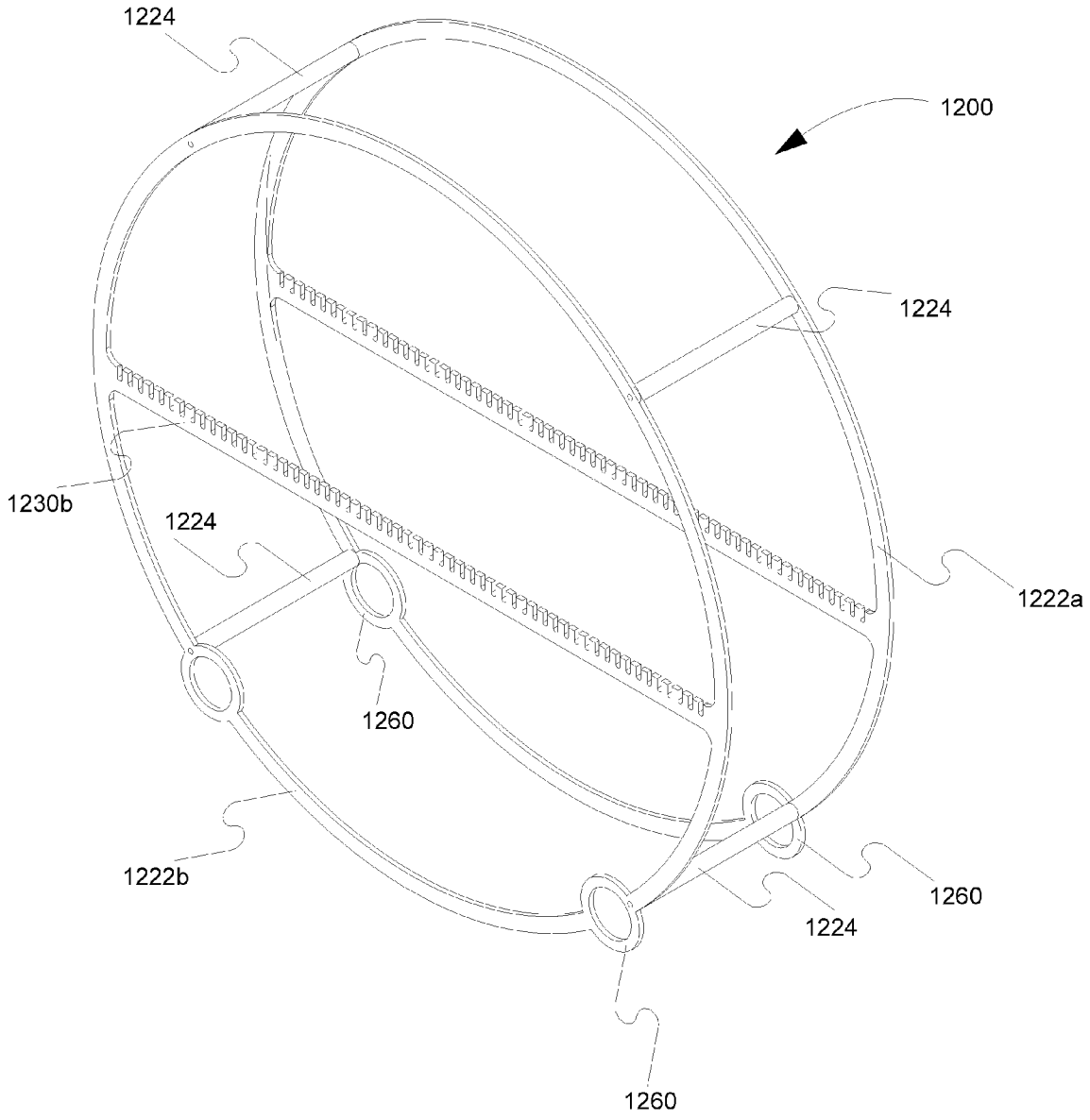
FIG. 17 is a perspective view of a candelabrum according to some aspects of the present disclosure.

Referring to FIG. 17, a candelabrum 1200 includes a first frame member 1222*a*, a second frame member 1222*b*, a first anchor beam 1230*a*, a second anchor beam 1230*b*, one or more cross members 1224, and stoppers 1260. The first and second frame members 1222*a,b* are coupled via the cross members 1224 in the same, or similar, manner as the frame members 22*a,b* are coupled via the cross members 24 as described above. The first and the second anchor beams 1230*a,b* are attached to, or integral with, the first and the second frame members 1222*a,b*, respectively. As shown in FIG. 17, the anchor beams 1230*a,b* are integral with the frame members 1222*a,b* and thus cannot be adjusted vertically in the manner described above in connection with the pair of anchor beams 30*a,b*. The stoppers 1260 aid in stabilizing the candelabrum 1200 during loading in the same manner as described in connection with the stoppers 1060 of FIG. 15.

The location of the stoppers 1060, 1160, and 1260 can be adjusted along the respective frame members to increase and/or decrease the amount of permitted rolling before the stopper aids in preventing further rolling. While two stoppers 1060 and 1160 are shown in FIGS. 15 and 16 and while four stoppers 1260 are shown in FIG. 17, various other numbers and/or orientations of stoppers are contemplated, such as, for example, one, two, three, five, seven, etc. stoppers per candelabrum. It is contemplated that one or more stoppers (e.g., stoppers 1060, 1160, 1260) can be included in any of the candelabrums of the present disclosure.

Referring to FIGS. 18A-18F, a candelabrum 1300 includes a frame assembly 1320, a pair of anchor beams 1330*a,b*, and a plurality of candle supports 1340 configured to hold a plurality of candles 1350. The frame assembly 1320 is the same as, or similar to, the frame assembly 20 described above in reference to FIGS. 4A-4C in that it includes first and second frame members 1322*a,b* and cross members 1324, which are the same as, or similar to, the frame members 22*a,b* and the cross members 24 described above. The pair of anchor beams 1330*a,b* are the same as, or similar to, the pair of anchor beams 930*a,b* described above in reference to FIGS. 14A-14C in that the pair of anchor beams 1330*a,b* includes a plurality of apertures instead of a plurality of slots. The plurality of candle supports 1340 are the same as, or similar to, the plurality of candle supports 40 described above in connection with FIGS. 1A-5.

The candelabrum 1300 includes a center of mass $M_{10}$ that is on an axis of rotation $R_{10}$ of the candelabrum 1300. Such an arrangement of the center of mass $M_{10}$ and the axis of rotation $R_{10}$ means that the candelabrum 1300 in a state of indifferent equilibrium. That is, the candelabrum 1300 is stable in all rotational positions (e.g., positions shown in FIGS. 18A, 18C, and 18E) such that the candelabrum 1300 can be rotated any amount and it will hold (i.e., stable) that rotated position. The candle supports 1340 and the candles 1350 therein load the pair of anchor beams 1330 at the same location irrespective of the rotational orientation of the frame assembly 1320 due to the candle supports 1340 being pivotally coupled to the pair of anchor beams 1330. Even as the candles 1350 burn and melt away, the mass of the candles 1350 reduce, which lowers the center of mass of the respective candles. Still, the candle supports 1340 load the pair of anchor beams 1330 at the same pivot points. The center of mass $M_{10}$ of the candelabrum 1300 therefore stays at the same position even as the candles 1350 burn.

Figure 18A:
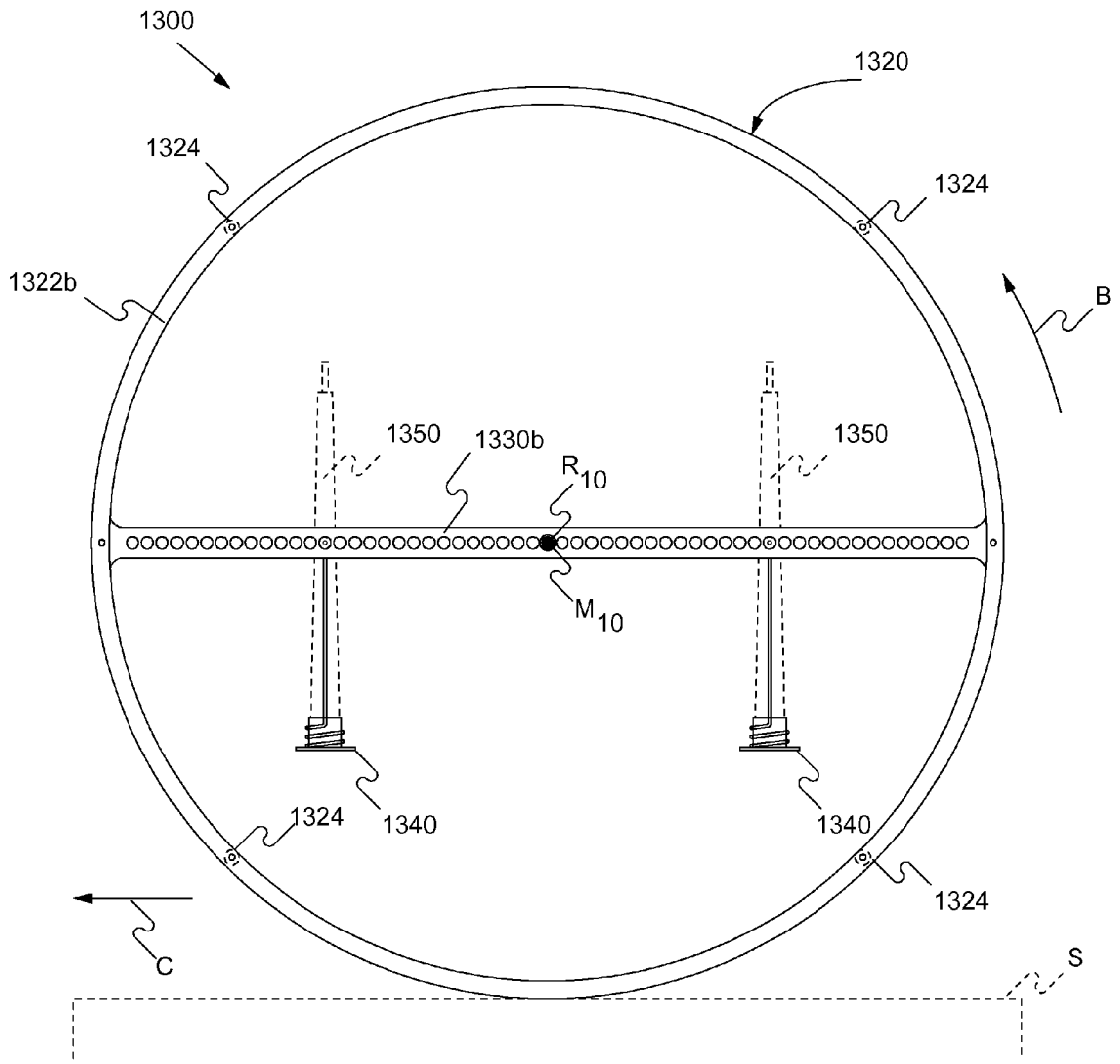
FIG. 18A is a front view of a candelabrum with candles installed according to some aspects of the present disclosure.
Figure 18B:
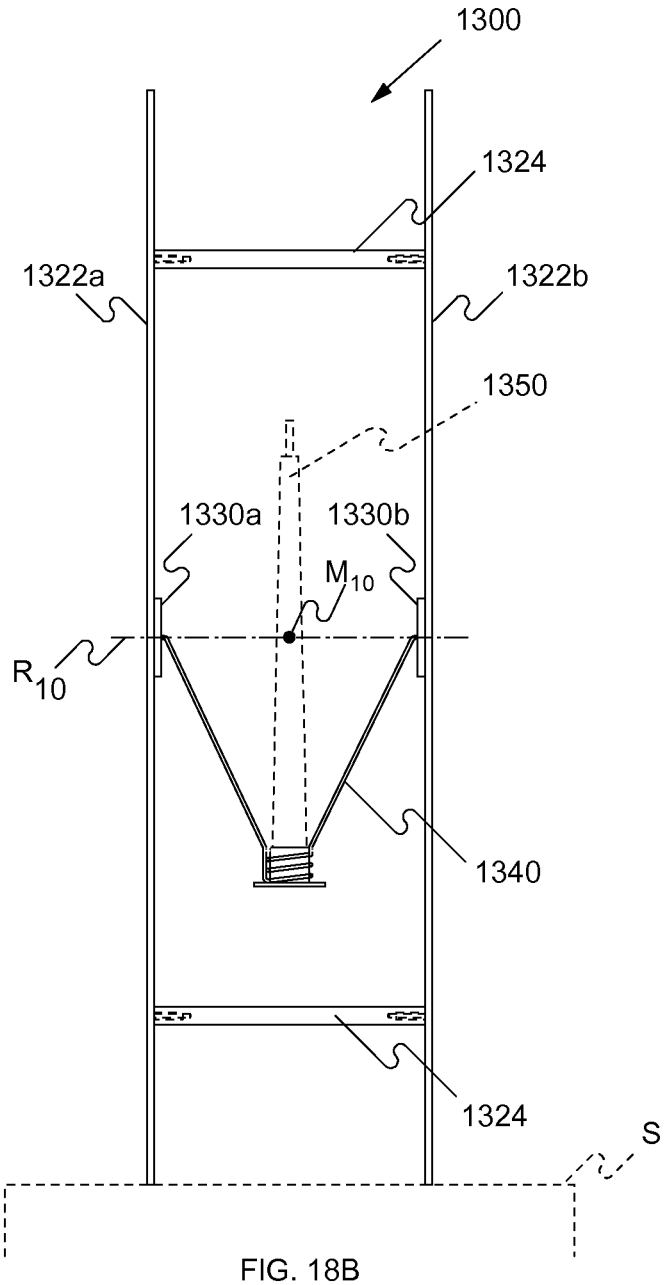
FIG. 18B is a side view of the candelabrum of FIG. 18A.
Figure 18C:
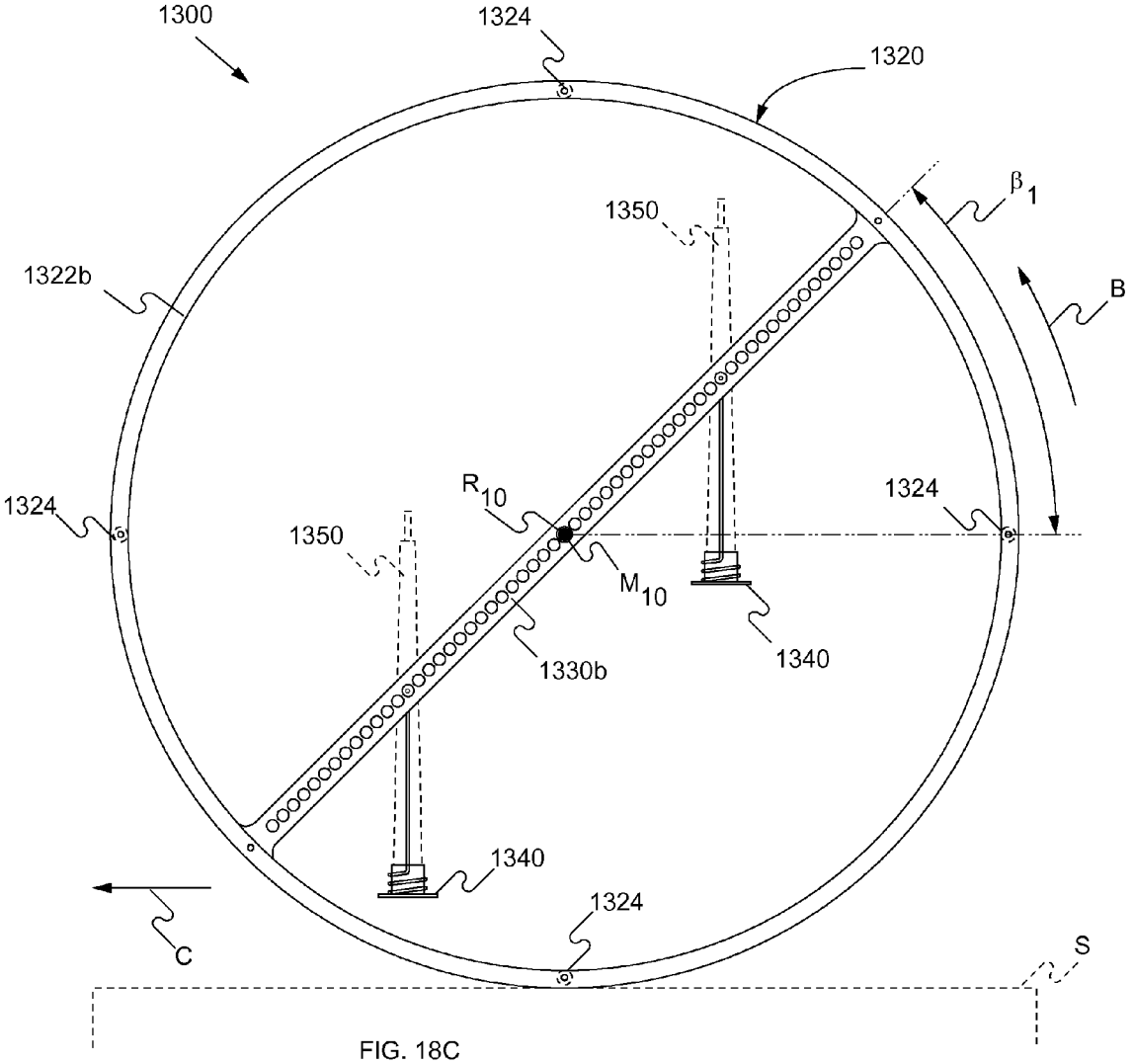
FIG. 18C is a front view of the candelabrum of FIG. 18A in a first instantaneous rolled position according to some aspects of the present disclosure.
Figure 18D:
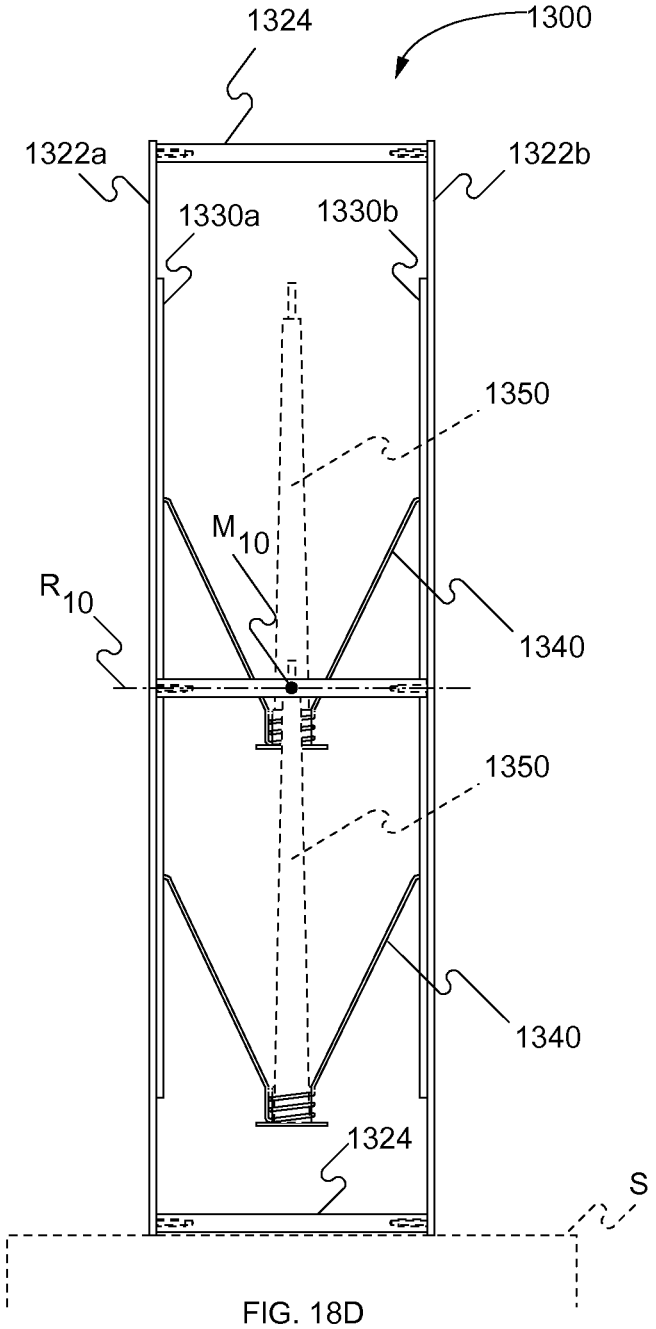
FIG. 18D is a side view of the candelabrum of FIG. 18C.
Figure 18E:
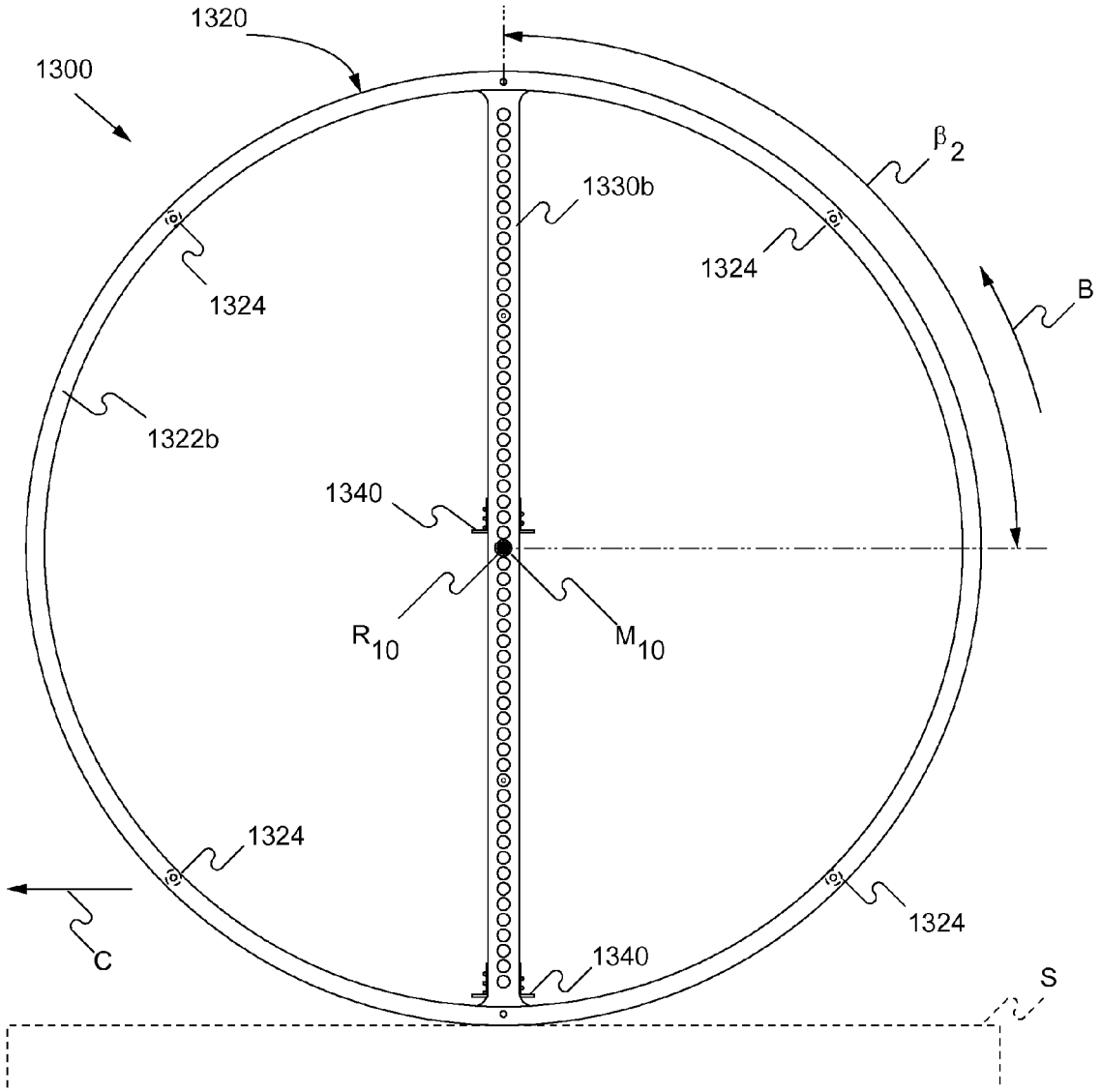
FIG. 18E is a front view of the candelabrum of FIG. 18A in a second instantaneous rolled position according to some aspects of the present disclosure.
Figure 18F:
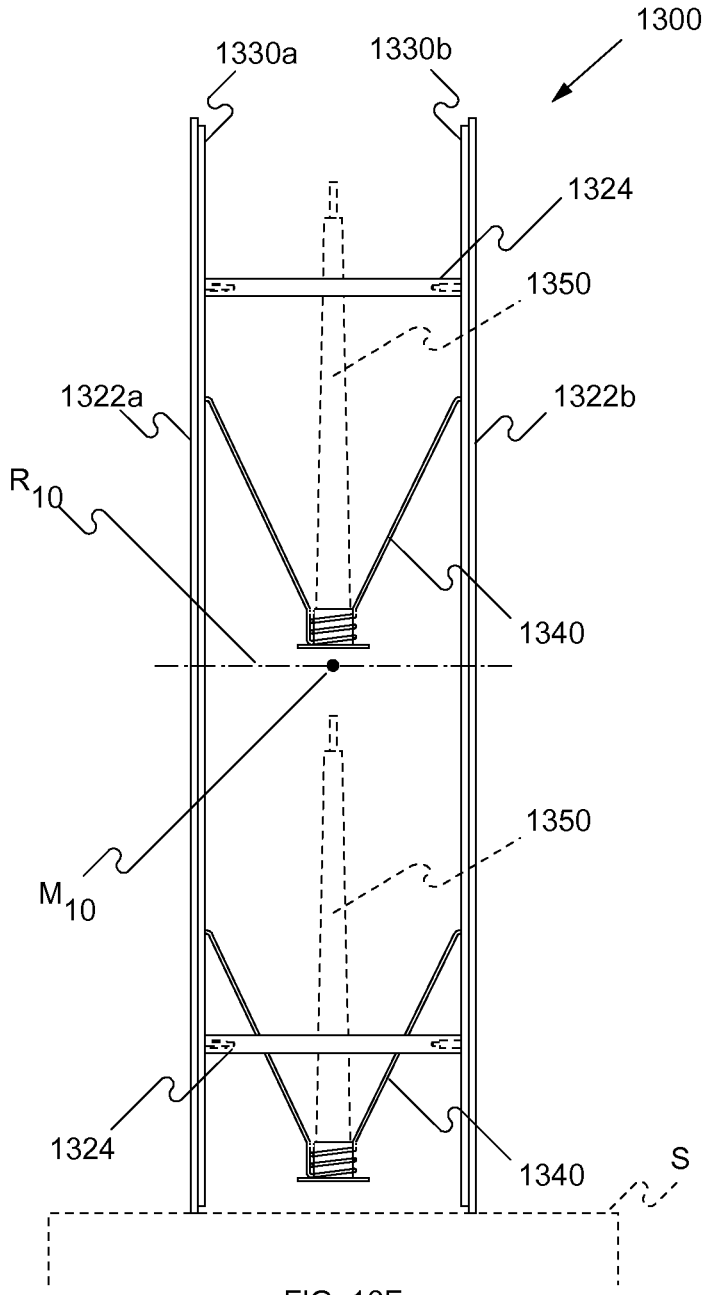
FIG. 18F is a side view of the candelabrum of FIG. 18E.

The candelabrum 1300 is configured to be rolled by an external disturbance along a surface, S, without significantly disturbing the substantially vertical orientation of the candles 1350 included in the candle supports 1340. The rotation of the candelabrum 1300 in the direction of arrow B causes the candelabrum to translate in the direction of arrow C (i.e., the candelabrum rolls in the direction of arrow C when rotated in the direction of arrow B). For example, as shown in FIGS. 18A and 18B, the candelabrum 1300 can be rotated from a stable equilibrium position (FIGS. 18A and 18B) in the direction of arrow B to a first instantaneous rolled position (FIGS. 18C and 18D) where the pair of anchor beams 1330*a,b* are at an angle of $\beta_1$ with respect to horizontal. In response to the external disturbance and/or a further external disturbance, the candelabrum 1300 can be further rotated in the direction of arrow B from the first instantaneous rolled position (FIGS. 18C and 18D) to a second instantaneous rolled position (FIGS. 18E and 18F) where the pair of anchor beams 1330*a,b* are at an angle of $\beta_2$ with respect to horizontal.

The candle supports 1340 are coupled to the pair of anchor beams 1330*a,b* at positions such that the candelabrum 1300 is free to rotate 360 degrees without the candle supports 1340 coming into contact with the surface, S, and without the adjacent candles 1350 coming into contact with each other and/or with the adjacent candle support 1340. While only two candles 1350 and two candle supports 1340 are shown, various other numbers and positions of candles 1350 and candle supports 1340 are possible. The dimensions of the candelabrum 1300 (i.e., the diameter of the frame assembly 1320, the length of the candles 1350, the length of the pair of anchor beams 1330) can be adjusted to accommodate a larger number of candles to avoid the candles 1350 and candle supports 1340 from contacting each other during rotation of the candelabrum 1300.

Alternatively to the candelabrum 1300 including a pair of anchor beams 1330*a,b*, the candelabrum 1300 can include a pair of anchor grids (not shown), which is the same as, or similar to, the pair of anchor grids 730*a,b* described above and shown in FIG. 12A.

The surface, S, upon which the candelabrum 1300 can be rotated can include one or more bearings (not shown) such that the candelabrum 1300 can rotate as described above but instead of translating along the surface, S, in the direction of arrow C, the candelabrum 1300 rotates in place on the one or more bearings. Additionally, the one or more bearings (not shown) can be motorized bearings such that a motor rotates or powers the bearings, which in turn causes the candelabrum 1300 to automatically rotate on the one or more bearings. The motor can be battery powered and/or plug-in powered and configured to receive AC and/or DC current. Additionally, the motorized bearings can further include a timer feature that is configured to activate at one or more preset times. For example, the timer feature can be programmed to turn on at 6 PM every Friday, automatically, such that the candelabrum is automatically rotated. The timer can be programmed to activate the motorized bearings for a predetermined amount of time, such as, for example, thirty minutes, one hour, two hours, twenty-four hours, etc.

Each of the disclosed candelabrums is designed to support one or more candles. As the candles burn and melt, the distribution of the weight of the remaining portions of the installed candles will vary as candles typically do not burn and/or melt at a uniform rate. Additionally, because some candles will invariably be lit before others, the candles lit first will typically burn up or melt before the other candles lit afterwards. Such a lighting scheme can also cause various weight distributions to occur during the course of using the candelabrums of the present disclosure. These uneven distributions of weight across the various candelabrums of the present disclosure can result in a non-uniform rocking and/or rolling response of the frame assembly of the candelabrums. Specifically, as the weight distribution varies (due to candle melting), the center of gravity of the candelabrum can shift causing the frame assembly to roll and the installed candle supports will pivot accordingly as described herein to safely maintain a substantially vertical orientation for each of the candles that remain lit. The non-uniform rocking and/or rolling response of the frame assembly of the candelabrums also provides entertainment and excitement to one or more persons viewing the candelabrum in operation.

While particular aspects, embodiments, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the present disclosure as defined in the appended claims.

What is claimed is:

1. A candelabrum, comprising:

a frame assembly including a first frame member, a second frame member, and a cross member, the first frame member being rigidly coupled to the second frame member via the cross member such that the first frame member is in a first plane and the second frame member is in a second plane;

a pair of anchor beams coupled to the frame assembly;

a first candle support pivotally coupled to the pair of anchor beams such that the first candle support is positioned between the pair of anchor beams, the first candle support being configured to receive a first candle therein; and a second candle support pivotally and directly engaging each of the pair of anchor beams such that the second candle support is not positioned between the pair of anchor beams, the second candle support being configured to receive a second candle therein.

2. The candelabrum of claim 1, wherein the first candle support includes a pair of pivot portions, a first one of the pair of pivot portions being configured to directly and pivotally engage a first one of the pair of anchor beams and a second one of the pair of pivot portions being configured to directly and pivotally engage a second one of the pair of anchor beams such that the first candle support is pivotally coupled to the pair of anchor beams.

3. The candelabrum of claim 2, wherein the second candle support includes a single pivot portion, the single pivot portion pivotally and directly engaging each of the pair of anchor beams such that the second candle support is pivotally coupled to the pair of anchor beams.

4. The candelabrum of claim 1, wherein the second candle support is pivotally coupled to the pair of anchor beams in a cantilevered configuration.

5. The candelabrum of claim 3, wherein the single pivot portion of the second candle support is longer than (i) the first one of the pair of pivot portions of the first candle support and (ii) the second one of the pair of pivot portions of the first candle support.

6. The candelabrum of claim 3, wherein the single pivot portion of the second candle support has a length that is about equal to a length of the cross member.

7. The candelabrum of claim 2, wherein the first candle support further includes a pair of arms and a base, the pair of arms coupling the pair of pivot portions to the base.

8. The candelabrum of claim 3, wherein the second candle support further includes a single arm and a base, the single arm coupling the single pivot portion to the base.

9. The candelabrum of claim 1, wherein each of the anchor beams has at least three receiving regions, each of the at least three receiving regions being an aperture.

10. The candelabrum of claim 1, wherein the first frame member and the second frame member are generally circular, generally semi-circular, generally elliptical, generally triangular, or generally polygonal.

11. The candelabrum of claim 1, wherein the frame assembly is configured to roll along a surface.

12. The candelabrum of claim 1, wherein the frame assembly is rotatable from a stable equilibrium position to a plurality of instantaneous rotated positions.

13. The candelabrum of claim 12, further comprising one or more stoppers coupled to the frame assembly, the one or more stoppers being configured to limit rotation of the frame assembly from the stable equilibrium position.

14. The candelabrum of claim 1, wherein the pair of anchor beams is adjustable with respect to the frame assembly to adjust a center of gravity of the candelabrum.

15. The candelabrum of claim 1, wherein the first candle support is configured to receive and support the first candle therein by engaging an end of the first candle opposite to the end of the first candle including a protruding wick and wherein the second candle support is configured to receive and support the second candle therein by engaging an end of the second candle opposite to the end of the second candle including a protruding wick.

16. The candelabrum of claim 1, further comprising a plurality of additional cross members rigidly coupling the first frame member to the second frame member.

17. The candelabrum of claim 16, wherein the cross member and each of plurality of additional cross members has the same length.

18. The candelabrum of claim 1, wherein a center of mass of the second candle support including the second candle therein is positioned below an axis of rotation of the second candle support.

19. A candelabrum, comprising:

a frame assembly including a first frame member, a second frame member, and a plurality of cross members, each of the plurality of cross members having the same length, the first frame member being rigidly coupled to the second frame member via the plurality of cross members such that the first frame member is in a first plane and the second frame member is in a second plane spaced from the first plane by a distance equal to the length of the plurality of cross members;

a pair of anchor beams coupled to the frame assembly;

a candle support having a pair of pivot portions, a first one of the pair of pivot portions being configured to directly engage a first one of the pair of anchor beams and a second one of the pair of pivot portions being configured to directly engage a second one of the pair of anchor beams such that the first candle support is pivotally coupled to the pair of anchor beams; and a cantilevered candle support having a single pivot portion, the single pivot portion being configured to directly engage the first one of the pair of anchor beams and the second one of the pair of anchor beams such that the cantilevered candle support is pivotally coupled to the pair of anchor beams.

20. The candelabrum of claim 19, wherein the frame assembly is rotatable from a stable equilibrium position to a plurality of instantaneous rotated positions.

21. The candelabrum of claim 20, further comprising one or more stoppers coupled to the frame assembly, the one or more stoppers being configured to limit rotation of the frame assembly from the stable equilibrium position.

22. The candelabrum of claim 19, wherein the single pivot portion of the cantilevered candle support has a length that is about equal to the length of each of the plurality of cross members.

23. The candelabrum of claim 19, wherein the cantilevered candle support further includes a single arm and a base, the single arm coupling the single pivot portion to the base.

24. The candelabrum of claim 19, wherein each of the anchor beams has at least three receiving regions, each of the at least three receiving regions being an aperture.

25. The candelabrum of claim 19, wherein the first frame member and the second frame member are generally circular, generally semi-circular, generally elliptical, generally triangular, or generally polygonal.

* * * * *